US006718619B2

(12) United States Patent
Lebaric et al.

(10) Patent No.: US 6,718,619 B2
(45) Date of Patent: Apr. 13, 2004

(54) METHOD OF MANUFACTURING A CENTRAL STEM MONOPOLE ANTENNA

(75) Inventors: Jovan E. Lebaric, Carmel, CA (US); Andy Dao, San Jose, CA (US)

(73) Assignee: Atheros Communications, Inc., Sunnyvale, CA (US)

( * ) Notice: Subject to any disclaimer, the term of this patent is extended or adjusted under 35 U.S.C. 154(b) by 0 days.

(21) Appl. No.: 09/912,450

(22) Filed: Jul. 24, 2001

(65) Prior Publication Data

US 2002/0116812 A1 Aug. 29, 2002

Related U.S. Application Data

(60) Provisional application No. 60/256,145, filed on Dec. 15, 2000.

(51) Int. Cl.[7] ..... H01Q 13/00; H01Q 21/00

(52) U.S. Cl. ..... 29/600; 29/601; 29/825; 29/835; 29/846; 29/842; 343/728

(58) Field of Search ..... 29/600, 601, 825, 29/835, 846, 842; 343/700 MS, 728, 702, 846, 700 R

(56) References Cited

U.S. PATENT DOCUMENTS

| | | | | |
|---|---|---|---|---|
| 3,681,771 A | | 8/1972 | Lewis et al. | 343/817 |
| 3,967,276 A | | 6/1976 | Goubau | 343/752 |
| 4,945,451 A | | 7/1990 | Gohl et al. | 361/386 |
| 5,113,196 A | | 5/1992 | Ponce de Leon et al. | 343/744 |
| 5,448,249 A | * | 9/1995 | Kushihi et al. | 343/700 MS |
| 5,621,419 A | * | 4/1997 | Meek et al. | 343/770 |
| 5,635,942 A | | 6/1997 | Kushihi et al. | 343/700 MS |
| 5,648,787 A | * | 7/1997 | Ogot et al. | 343/826 |
| 5,864,318 A | * | 1/1999 | Cosenza et al. | 343/700 MS |
| 6,304,227 B1 | * | 10/2001 | Hill et al. | 343/769 |

FOREIGN PATENT DOCUMENTS

| | | |
|---|---|---|
| DE | 198 28 122 | 12/1999 |
| DE | 100 03 082 | 7/2001 |
| DE | 100 35 820 | 1/2002 |
| EP | 0 993 070 | 4/2000 |
| EP | 1 024 552 | 8/2000 |
| FR | 1.313.861 | 1/1963 |
| WO | WO 96/35241 | 11/1996 |

* cited by examiner

*Primary Examiner*—Carl J. Arbes
*Assistant Examiner*—Tai Nguyen
(74) *Attorney, Agent, or Firm*—Pillsbury Winthrop LLP

(57) ABSTRACT

Methods of manufacturing an antenna are presented. The antenna is capable of being mounted on a printed circuit board. In accordance with the method, the design dimension of a unitary piece of material are selected according to an operating wavelength. The unitary piece of material is stamped out from a larger section of material according to the design dimensions to form an antenna. The unitary piece of material includes a circular area and a stem area. The circular area has a center and an outer region. The stem area has a first end and a second end. The first end is joined with the center. The unitary piece is bendable at the first end and the center.

31 Claims, 21 Drawing Sheets

METHOD OF MANUFACTURING A CENTRAL STEM MONOPOLE ANTENNA

CROSS REFERENCE TO RELATED APPLICATIONS

The present application is based on, and claims priority from, U.S. Provisional Application No. 60/256,145, filed Dec. 15, 2000.

FIELD OF THE INVENTION

The present invention is directed to wireless voice and data communications, and more particularly to manufacturing a monopole antenna as a unitary piece.

BACKGROUND

An antenna is a device that transmits electrical signals into free space. The signals may be, for example, received by another antenna in a proximate or a distant location. A common antenna configuration is the well-known monopole antenna. A typical monopole consists of a straight wire mounted above and operating against a ground plane. A transmission arrangement such as a transmission line feeds electrical signals to the monopole with the ground plane serves as the ground potential for the transmission arrangement. An insulator is used to provide electrical separation between the monopole and the ground plane. As is well known in the art, the ground plane provides a mirror image for the monopole mounted above it so that from the perspective of the antenna it is as if another monopole antenna is located below the ground plane. In this way, the ground plane and the monopole antenna mimic a dipole antenna arrangement. For optimum performance of the monopole antenna at a particular frequency $f$ of operation the length of the monopole antenna will be approximately one-quarter of the operating wavelength $\lambda$ at that operating frequency $f$, or $\lambda/4$.

In general, for an antenna arrangement such as the typical monopole, the operating wavelength $\lambda$ is related to the operating frequency $f$ through the following relation:

$$\lambda = \frac{c}{f\sqrt{\varepsilon_r}} \tag{1}$$

where c is the speed of light in vacuum and $\epsilon_r$ is a relative permittivity associated with the insulator. Typically the operational frequency $f$ is fixed by the application and the frequency limits design choices for the dimensional properties of the antenna.

Minimization of the space taken up by components is often of paramount importance in the design of devices such as wireless computing and other portable devices. For high-frequency applications that require antennas mounted on printed circuit boards, a typical monopole antenna arrangement may be impractical because of the antenna lengths at the high frequencies. A common substrate used to construct printed circuit boards is FR4® board has a relative permittivity $\epsilon_r$ of approximately 4.25. As an example of an antenna length at a high frequency, assuming that $\epsilon_r \cong 1$, at an exemplary frequency of 5.25 GHz ($5.25\times10^9$ Hz) the operating wavelength within the FR4 substrate will be approximately 57 millimeters (mm) and the corresponding $\lambda/4$ length of the antenna will be approximately 14 mm. For some applications, antennas with comparable lengths simply consume too much space in the vertical direction relative to the ground plane so as to be prohibitive in terms of their use.

The need to decrease the length of antenna configurations relative to a ground plane has led to a number of antenna arrangements, particularly in instances where horizontal space is available relative the ground plane. One example is the inverted L antenna arrangement. The inverted L is essentially a typical monopole antenna that is bent at approximately 90 degrees. Typically, the total length of the inverted L antenna, including the bent portion, will be $\lambda/4$, however a significant portion of that length may be in the bent portion that is approximately parallel to the ground plane. This decreases the length of the antenna portion that protrudes in the vertical direction relative to the ground plane. In most practical cases, this length will be no less than $\lambda/8$ due to the need to provide mechanical support for the bent portion of the antenna.

While this inverted L arrangement can achieve significant improvement in length reduction from the typical monopole antenna arrangement, better performance and length reduction can be achieved with the well-known top hat antenna. FIG. 1 is a diagram illustrating a side view of a traditional top hat antenna 100 mounted on a printed circuit board (PCB) 102. The top hat antenna 100 includes a disk or circular hat 104 of radius r and diameter d, and a cylindrical stem 106 of height h. Generally, the stem 106 and the circular hat 104 of the top hat antenna 100 are distinct pieces that are fused together via any of a series of well-known manufacturing processes to realize the top hat antenna 100. The top hat antenna 100 could also be machined from a single piece of metal. The PCB 102 includes a layer 108 of dielectric material, a ground plane 110, and a microstrip line or feed strip 112. The thicknesses of the dielectric layer 108, the ground plane 110, and the feed strip 112 are exaggerated relative to the top hat antenna 100 and to one another for purposes of illustration. For example, the feed strip 112 and the ground plane 110 are typically microthin layers of metal, for example, copper. The feed strip 112 includes a contact area 114 and forms a microstrip with the ground plane 110 and the dielectric layer 108 to provide electrical signals to the top hat antenna 100 at the contact area 114 where the strip 112 contacts the stem 106. Typically, the stem 106 of the top hat antenna 100 is soldered or otherwise fused to the feed strip 112 at the contact area 114. The dielectric layer 108 insulates the top hat antenna 100 from the ground plane 110. The top hat antenna 100 operates against the ground plane 108 to similarly mimic a dipole antenna effect.

The height h of the stem 106 together with the diameter d of the circular hat 104 are typically equal to one quarter of the operating wavelength $\lambda$ at the operating frequency $f$, or $\lambda/4$. Typically, this implies that the height h of the stem 106 and thus the top hat antenna 100 approaches as low as $\lambda/12$. The top hat antenna 100 is an electrically small antenna, that is, the length of the antenna 100 is much smaller than the operating wavelength $\lambda$. In general, the performance of the traditional top hat antenna 100 at a particular operating frequency will vary according to the dimensions d and h of the antenna 100. Overall, the top hat antenna 100 provides substantial savings in terms of height relative to the ground plane 110.

One drawback of the traditional top hat antenna arrangement relates to mounting the top hat antenna on a PCB. The antenna is typically soldered or otherwise fused to the top of the PCB and to a microstrip line. Actually soldering the top hat antenna to the PCB is a complicated and mechanically precarious procedure in and of itself. The shape of the top hat antenna requires that an operator or a machine apply the solder at a difficult angle. A traditional monopole antenna does not present the same degree of difficulty in soldering.

Soldering either the monopole or the top hat antenna to the top side of the PCB, however, is a process step that might not otherwise be necessary on the top side of the PCB but for the mounting of antennas. Put another way, a top hat antenna or a monopole antenna might be the only element that requires soldering to the top side of the PCB.

It would be desirable to provide a structurally stable arrangement for mounting an antenna that eliminates a soldering process on the top side of a printed circuit board, and that alleviates many of the difficulties inherent in mounting certain types of antennas on the printed circuit board.

An additional drawback of the traditional top hat antenna arrangement relates to manufacturability of the antenna. While a traditional top hat antenna may be machined from a single piece of metal, the antenna is generally formed by soldering, or by otherwise fusing, two distinct pieces of material to each other, one piece representing the circular hat, for example, and one piece representing the stem, for example. A manufacturing process that serves to accomplish this soldering or fusing together of pieces will typically be somewhat complicated and prone to error because of the lengths and the sizes of the pieces involved. As a result, the process typically proves to be fairly expensive on a per element basis and may be quite costly to implement on a mass production basis.

It would be desirable to provide an antenna of minimal length, in terms of its height when positioned above a ground plane, that is less complicated and less expensive to manufacture than a traditional top hat antenna but that does not significantly compromise performance relative to, for example, the traditional top hat antenna.

SUMMARY

Methods of manufacturing antennas that are capable of being mounted on printed circuit boards are presented.

A method of manufacturing an antenna according to a presently preferred embodiment is presented in a first aspect of the present invention. The antenna is capable of being mounted on a printed circuit board. The design dimensions of a unitary piece of material are selected according to an operating wavelength. The unitary piece of material is stamped out from a larger section of material according to the design dimensions to form an antenna. The unitary piece includes a circular area and a stem area. The circular area has a center and an outer region. The stem area has a first end and a second end. The first end is joined with the center. The unitary piece is bendable at the first end and the center.

A method of manufacturing an antenna according to a presently preferred embodiment is presented in a second aspect of the present invention. The antenna is capable of being mounted on a printed circuit board. The design dimensions of a unitary piece of material are selected according to an operating wavelength. The unitary piece of material is stamped out from a larger section of material according to the design dimensions to form an antenna. The unitary piece includes a circular area, a stem area, and a foot area. The circular area has a center and an outer region. The stem area has a first end and a second end. The first end is joined with the center. The unitary piece is bendable at the first end and the center. The foot area has a third end and a fourth end. The third end is joined with the second end. The unitary piece is bendable at the third end and the second end.

A method of manufacturing an antenna according to a presently preferred embodiment is presented in a third aspect of the present invention. The antenna is capable of being mounted on a printed circuit board. The design dimensions of a unitary piece of material are selected according to an operating wavelength. The unitary piece of material is stamped out from a larger section of material according to the design dimensions to form an antenna. The unitary piece includes a circular area, a stem area, and a root area. The circular area has a center and an outer region. The stem area has a first end and a second end. The first end is joined with the center. The unitary piece is bendable at the first end and the center. The root area has a third end and a fourth end. The third end is joined with the second end. The second end has a first width and the third end has a second width. The first width exceeds the second width.

BRIEF DESCRIPTION OF THE DRAWINGS

The foregoing and other features, aspects, and advantages will become more apparent from the following detailed description when read in conjunction with the following drawings, wherein.

DETAILED DESCRIPTION OF THE PRESENTLY PREFERRED EMBODIMENTS

Figure 1:
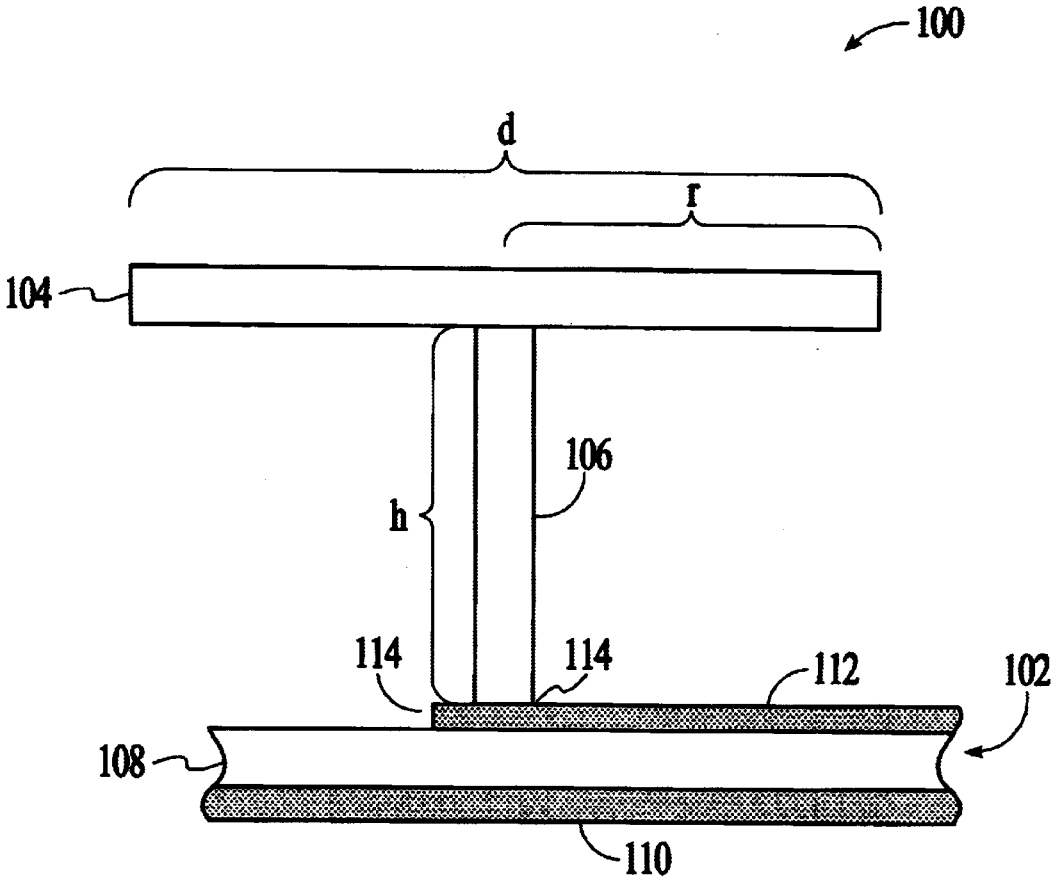
FIG. 1 (PRIOR ART)
FIG. 1 is a diagram illustrating a top hat antenna from the prior art.

The present invention will now be described in detail with reference to the accompanying drawings, which are provided as illustrative examples of preferred embodiments of the present invention.

Copending U.S. applications Ser. No. 09/915,209 filed on Jul. 24, 2001, now, U.S. Pat. No. 6,538,605 and entitled METHOD AND SYSTEM FOR MOUNTING A MONOPOLE ANTENNA, and Ser. No. 09/912,455 filed on Jul. 24, 2001 and entitled METHOD OF MANUFACTURING A SIDE STEM MONOPOLE ANTENNA, and any divisional or continuation applications issuing therefrom, are hereby incorporated by reference herein.

Presented herein is a top-loaded monopole antenna according to a presently preferred exemplary embodiment, the stem of which is preferably formed by cutting a rectangular slot in a circular hat area of a unitary piece of material and by preferably bending the stem area formed by the cutting of the slot such that the stem area is perpendicular to the circular hat and remains joined with the hat, preferably at the center of the circular hat. Of course, the slot and thus the stem are not limited to rectangular shapes, and other shapes may be used as suitable. For example, the stem may be tapered to increase in width as it approaches the center of the circular hat. Since the stem of the antenna is joined with the hat, preferably at its center, and when bent in the manner described above leaves a slot visible in the circular hat, the antenna may be referred to as a slotted-hat antenna. The material used to construct the antenna may be, for example, a metal such as copper, although any suitable material, or combination of materials, may be used. In a preferred embodiment, the antenna is made out of one continuous stamped piece of flat metal.

The antenna may be mounted onto a PCB by inserting an area of the antenna identified as the root into a through-hole or, more broadly, an opening, on the PCB. In another embodiment, the antenna may be surface mounted onto the PCB by soldering or otherwise fusing an area of the antenna identified as the foot onto, for example, a microstrip line on the PCB. The foot area is preferably bent at the stem area such that the foot area is perpendicular to the stem area and remains joined with the stem area. The physical dimensions of the antenna, including those of the circular hat and the slot in the circular hat from which the stem was cut, are specifically designed to achieve optimum performance at the desired operating frequency. The antenna preferably allows for inexpensive manufacturing and easy mounting on a PCB, while preferably exhibiting desirable performance in this environment.

As an example, a slotted-hat antenna according to a presently preferred embodiment was simulated using an antenna computer simulation program and was built as a prototype. The particular side stem antenna included a circular hat, a stem, and a root. The root was used for mounting the antenna onto a PCB in a 50 Ohm microstrip feed system according to a mounting technique described in co-pending U.S. application Ser. No. 09/912,455 filed on Jul. 24, 2001 and incorporated by reference herein. The antenna of this presently preferred embodiment was designed to operate at a frequency of 5.25 GHz with a bandwidth of around 300 MHz at a voltage standing wave ratio (VSWR) of less than 2 and a bandwidth of around 500 MHz at a VSWR of less than 3. This exemplary antenna radiates omni-directionally in the mounting plane with vertical polarization and gain greater than 1 dB.

The slotted-hat antenna may be used, for example, in any product that requires an antenna to be mounted on a PCB, specifically an antenna that preferably operates at a frequency of 2 GHz or above. Of course, it should be understood that the antenna is not limited to frequencies in the GHz range or higher. Neither is the antenna limited to PCB mounting environments. By adjusting the dimensions of the physical geometry of the antenna to fit a particular application, the antenna may be used with different parameters and in different environments.

The slotted hat antenna as described herein is a minimal length monopole antenna that is less complicated and less expensive to manufacture than a traditional top hat antenna. The slotted hat antenna is easy to manufacture, since the antenna is preferably stamped out as a unitary piece of continuous material and preferably requires limited manipulation, i.e., bending, to achieve a desired physical shape. The slotted hat antenna provides comparable performance relative to, for example, the traditional top hat antenna and can, through adjustment of its dimensions, be designed to operate at a wide variety of frequencies and in many environments.

The Side Stem Antenna

Figure 2:
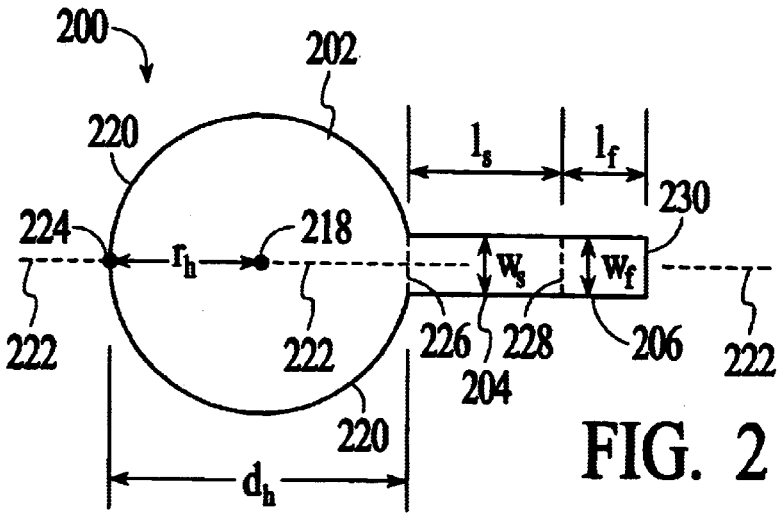
FIG. 2 is a diagram illustrating a top view of an exemplary continuous, unitary piece of material used to form an exemplary side stem antenna according to a first presently preferred embodiment.

Referring now to FIG. 2, it is a diagram illustrating a top view of an exemplary continuous, unitary piece of material 200 used to form an exemplary side stem antenna 200 according to a first presently preferred embodiment. The material 200 is illustrated prior to bending of the material 200 into a shape of the antenna 200. The unitary piece of material 200 includes a circular hat area or hat 202, a stem area or stem 204, and a foot area or foot 206. The circular hat area 202 includes a center 218 and an outer region 220 that extends along the portion of the perimeter of the material 200 that includes the circular hat area 202. The dimensional parameters of the antenna 200 include a diameter $d_h$ of the hat 202, a radius $r_h$ of the hat 202 that is preferably defined, for example, from the center 218 to a point 224 on the outer region 220 along a radial axis 222, a width $w_s$ of the stem 204, a width $w_f$ of the foot 206, a length $l_s$ of the stem 204, and a length $l_f$ of the foot 206. In a preferred embodiment, the length $l_f$ of the foot 206 is equivalent to the width $w_s$ of the stem 204 and to the width $w_f$ of the foot 206, although the relative dimensions of the antenna 200 may vary as suitable according to the particular application in which the antenna 200 is used.

The dotted lines 226, 228 in FIG. 2 are included for purposes of illustration to indicate the various areas 202, 204, 206 and to identify desired lines at which the unitary piece of material 200 is bendable, or may be bent, to form the side stem antenna 200. The material 200 may contain an impression or a ridge along a desired bending line, such as that identified by the dotted lines in FIG. 2, that aids in bending the material 200 into the shape of the antenna 200. The length $l_s$ of the stem 204 is defined between the dotted lines 226, 228. The stem 204 is joined with the outer region 220 of the circular hat 202 at the dotted line 226. The stem 204 protrudes outward from the outer region 220 along the radial axis 222. The unitary piece of material 200 is bendable, and thus an angle between the hat 202 and the stem 204 is adjustable, at the dotted line 226. The length $l_f$ of the foot 206 is defined between the dotted line 228 and an end 230 of the foot area 202 and of the material 200. The foot 206 is joined with the stem 204 at the dotted line 228. The unitary piece of material 200 is bendable, and thus an angle between the stem 204 and the foot 206 is adjustable, at the dotted line 228.

Figure 3:
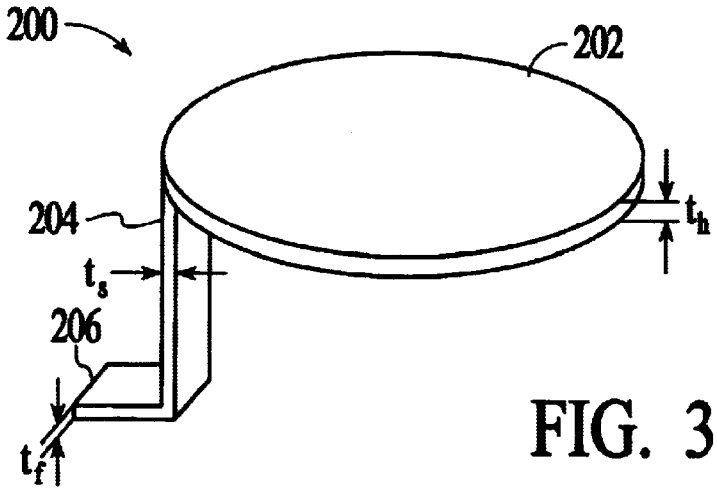
FIG. 3 is a diagram illustrating a three dimensional view of the exemplary unitary piece of material of FIG. 2 formed into the shape of the exemplary side stem antenna of FIG. 2.

FIG. 3 is a diagram illustrating a three dimensional view of the exemplary unitary piece of material 200, formed into the shape of the exemplary side stem antenna 200. The dimensional parameters of the antenna 200 further include a thickness $t_h$ of the circular hat 202, a thickness $t_s$ of the stem 204, and a thickness $t_f$ of the foot 206. In general, the unitary piece of material 200, and thus the side stem antenna 200, will have uniform thickness throughout the hat 202, stem 204, and foot 206 areas, although, of course, other thicknesses are possible. In a preferred embodiment, the material 200 is a metal material, such as copper, although any suitable conductive material may be used as suitable. The material 200 is preferably stamped out in the shape illustrated in FIG. 2 from a larger planar, flat, continuous, piece of material in a manufacturing process. Preferably, the material 200 is stamped out in accordance with the design dimensions of the side stem antenna 200. Any cutting or stamping process may be used as suitable to stamp out the material 200 from the larger piece. The larger piece of material will typically be available in standard widths from material manufacturers and a standard width may be chosen, for example, for mechanical stability purposes, for durability, or for bendability.

In FIG. 3, the unitary piece of material 200 is bent into a shape capable of operating as an antenna. As shown in FIG. 3, preferably the unitary piece of material 200 is bent so that the hat 202 and the stem 204 are perpendicular to one another. Of course, the angle between the hat 202 and the stem 204 is variable and may be adjusted as suitable for performance or mechanical stability reasons, for example. Preferably the unitary piece 200 is bent so that the stem 204 and the foot 206 are perpendicular to one another. Of course, the angle between the stem 204 and the foot 206 is variable and may be adjusted as suitable for performance or mechanical stability reasons, for example.

Preferably, the design dimensions of the antenna 200 are selected in accordance with the environment within which the antenna is intended to operate. For example, in a preferred embodiment, the design dimensions are selected according to an operating frequency, and a corresponding operating wavelength, or corresponding ranges of these, for the antenna 200.

Although selection of the design dimensions is a matter of design choice, as a designer must determine the relative importance of different performance criteria, some rules of thumb may accompany design intuition and numerical modeling of the design dimensions. For example, in a preferred embodiment, the desired length $l_s$ of the stem 204 of the side stem antenna 200 is approximately one-tenth to one-twelfth of the operating wavelength, or from $\lambda/10$ to $\lambda/12$, in the interest of minimizing the height of the antenna 200 above, for example, a PCB. Preferably, the height of the antenna 200 above the PCB is roughly equivalent to the length $l_s$ of the stem 204. A design rule of thumb to achieve the length $l_s$ and to maintain acceptable performance that is comparable to the traditional top hat antenna 100 illustrated in FIG. 1, is to make the radius $r_h$ of the hat 202 approximately equivalent to the length $l_s$ of the stem 204 so that:

$$d_h = 2r_h \approx 2l_s \tag{2}$$

and $$d_h + l_s = 2r_h + l_s \approx \frac{\lambda}{4} \tag{3}$$

where, as above, $d_h$ is the diameter of the hat 204. In a preferred embodiment, the radius $r_h$ of the hat and the length $l_s$ of the stem are selected to satisfy (3) and to minimize $l_s$.

For example, if the length $l_s$ is selected to be approximately equal to $\lambda/12$, then according to (3) the radius $r_h$ should be approximately equal to $\lambda/12$. As another example, if the length $l_s$ is selected to be approximately equal to $\lambda/10$, then to satisfy (3) the radius $r_h$ should be approximately equal to $\lambda/13$.

Figure 4:
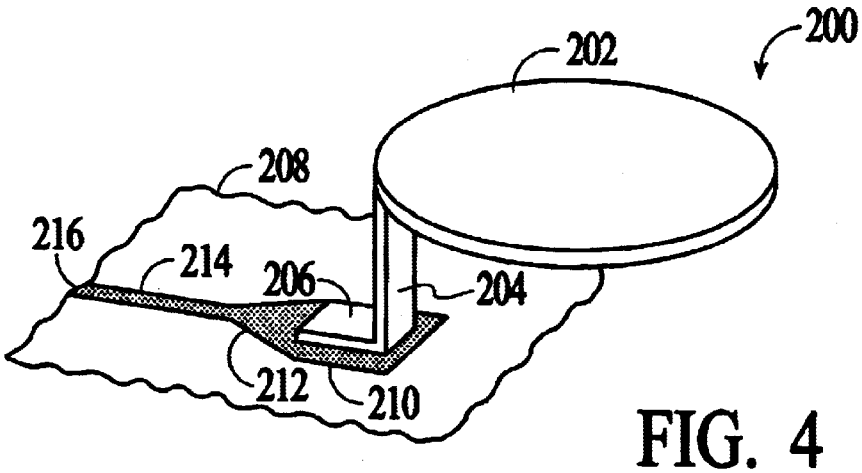
FIG. 4 is a diagram illustrating a three dimensional view of the exemplary side stem antenna of FIGS. 2–3 mounted on a printed circuit board.
Figure 24:
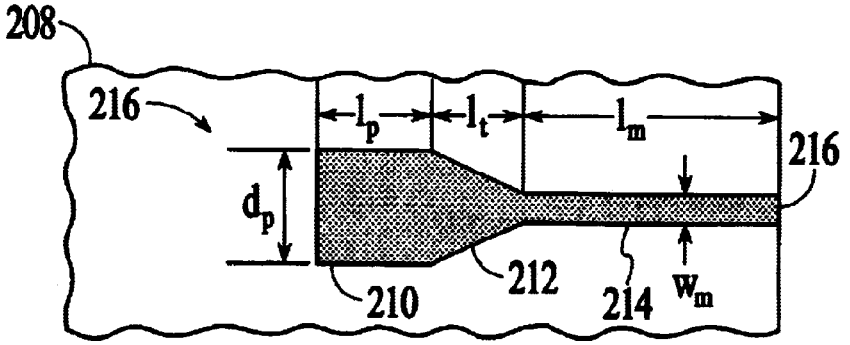
FIG. 24 is a diagram illustrating a top view of an exemplary transmission feed according to FIG.4.

The antenna 200 is capable of being mounted on a printed circuit board (PCB), as shown in FIG. 4. The antenna 200 of FIG. 4 is mounted on a PCB 208 and contacts a transmission feed 216 that is laid out along the top side of the PCB 208. The PCB 208 includes, for example, a substrate such as FR4® board, although other dielectric materials may be used as suitable. FIG. 24 is a diagram illustrating a top view of the exemplary transmission feed 216 of FIG. 4 without the antenna 200. The transmission feed 216 preferably includes a microstrip line 214, a taper region 212, and a contact area or connecting pad 210. Preferably, the transmission feed 216 is a microthin layer of metal film, such as copper, although other metals and conductive materials may be used as suitable.

As can been seen from FIG. 4, the purpose of the foot 206 of the antenna 200 is to mount the antenna 200 on a surface, such as the PCB 208. Preferably, a process is used to solder, or otherwise fuse, the foot 206 of the antenna 200 to the PCB 208. The width $w_f$ and the length $l_f$ of the foot 206 are critical for mechanical stability of the antenna 200. The dimensions are preferably carefully selected using mechanical intuition and numerical simulation so that the foot 206 is long enough and so that the foot 206, and the stem 204 at its end nearest the foot 206, are wide enough to mechanically support the antenna 200 and maintain the antenna 200 in the position illustrated in FIG. 4, i.e., so that the hat 202 is parallel to the PCB 208. For example, if the length $l_f$ of the foot 206 is too short relative to the rest of the antenna 200, and provides no counterbalance to the stem 204 and the hat 206, the foot 206 may peel off from the connecting pad 210. Similarly, if the width $w_f$ of the foot 206 and the width $w_s$ of the stem is too thin relative to the hat, the antenna 200 may not be supported effectively, and may be prone to undesired bending or breaking.

The width $w_f$ of the foot 206, in turn, determines the width $w_p$ of the connecting pad 210 and the width of the taper region 212 where the taper region 212 joins with the connecting pad 210. The connecting pad 210 is preferably used to make electrical contact with the foot 206 and thus the antenna 200, and to provide a surface onto which the foot 206 and the antenna 200 may be soldered. The microstrip line 214, as is commonly known in the art, is a structure that behaves like a transmission line at microwave frequencies and that transmits electrical signals in conjunction with a dielectric layer and a ground plane, in this case with the PCB 208. For a given width, such as width $w_m$, of microstrip line and a given height of the microstrip line above a ground plane, typically the thickness of the PCB layer, there is an impedance associated with the microstrip line. Preferably, the taper region 212 is used to match the input impedance of the antenna 200 with the microstrip line 214. The length $l_t$ of the taper region 212 is dependent on how abrupt a transformation of the microstrip line 214 to the connecting pad 210 is acceptable for a particular application. The tradeoff for this parameter is between reducing the length $l_{feed}$ of the transmission feed 216 to save area on the PCB 208 and avoiding unwanted reflections that can result from a more abrupt transformation from the width $w_m$ of the microstrip line 214 to the width $w_p$ of the connecting pad 210. The length $l_p$ of the connecting pad 210 preferably is determined according to the length $l_f$ of the foot 206.

Table I shows the results of a computer simulation run using a standard antenna design simulation software package, as well as the assumed values for various dimensions of an exemplary side stem antenna 200 implemented as in FIG. 4. The values for the dimensions of the exemplary side stem antenna 200 were obtained through iterative optimization using the software package. A exemplary prototype implementation of the side stem antenna 200 of FIG. 4 utilizes FR4® board as the dielectric material for the PCB 208.

TABLE I

Simulation results for an exemplary implementation of the exemplary side stem antenna 200 with foot 206 of FIG. 4; including dimensions of the exemplary transmission feed 216 of FIGS. 4 and 24.

| Element/Dimension | Value |
|---|---|
| Operating Frequency | 5.25 GHz |
| Material 200 Thickness $t_h$, $t_s$, $t_f$ | 0.2 mm |
| Diameter of Hat 202 $d_h$; $2r_h$ | 8.432 mm |
| Length of Stem 204 $l_s$, ≈ Height above | 4.22 mm |
| PCB 208 | $\left[d_h = 2r_h \approx 2l_s;\ d_h + l_s = 2r_h + l_s \approx \frac{\lambda}{4}\right]$ |
| Width of Stem 204 $w_s$; Width of Foot 2O6 $w_f$ | 1.69 mm |
| Length of Foot 206 $l_f$ | 1.69 mm |
| Length of Transmission Feed 216 | 8.96 mm |
| | $[l_{feed} = l_p + l_t + l_m]$ |
| Thickness of Transmission Feed 216 | 0.07 mm (70 $\mu$m) |
| Impedance of Microstrip Line 214 | 50 Ω |
| Width of Microstrip Line 214 $w_m$ | 0.45 mm |
| Length of Microstrip Line 214 $l_m$ | 4.76 mm |
| Length of Taper Region 212 $l_t$ | 1.9 mm |
| Width of Connecting Pad 210 $w_p$ | 2.3 mm |

TABLE I-continued

Simulation results for an exemplary implementation of the exemplary side stem antenna 200 with foot 206 of FIG. 4; including dimensions of the exemplary transmission feed 216 of FIGS. 4 and 24.

| Element/Dimension | Value |
|---|---|
| Length of Connecting Pad 210 $l_p$ | 2.3 mm |
| FR4 ® board (PCB 208) | $\epsilon_R \approx 4.25$ |

Figure 28:
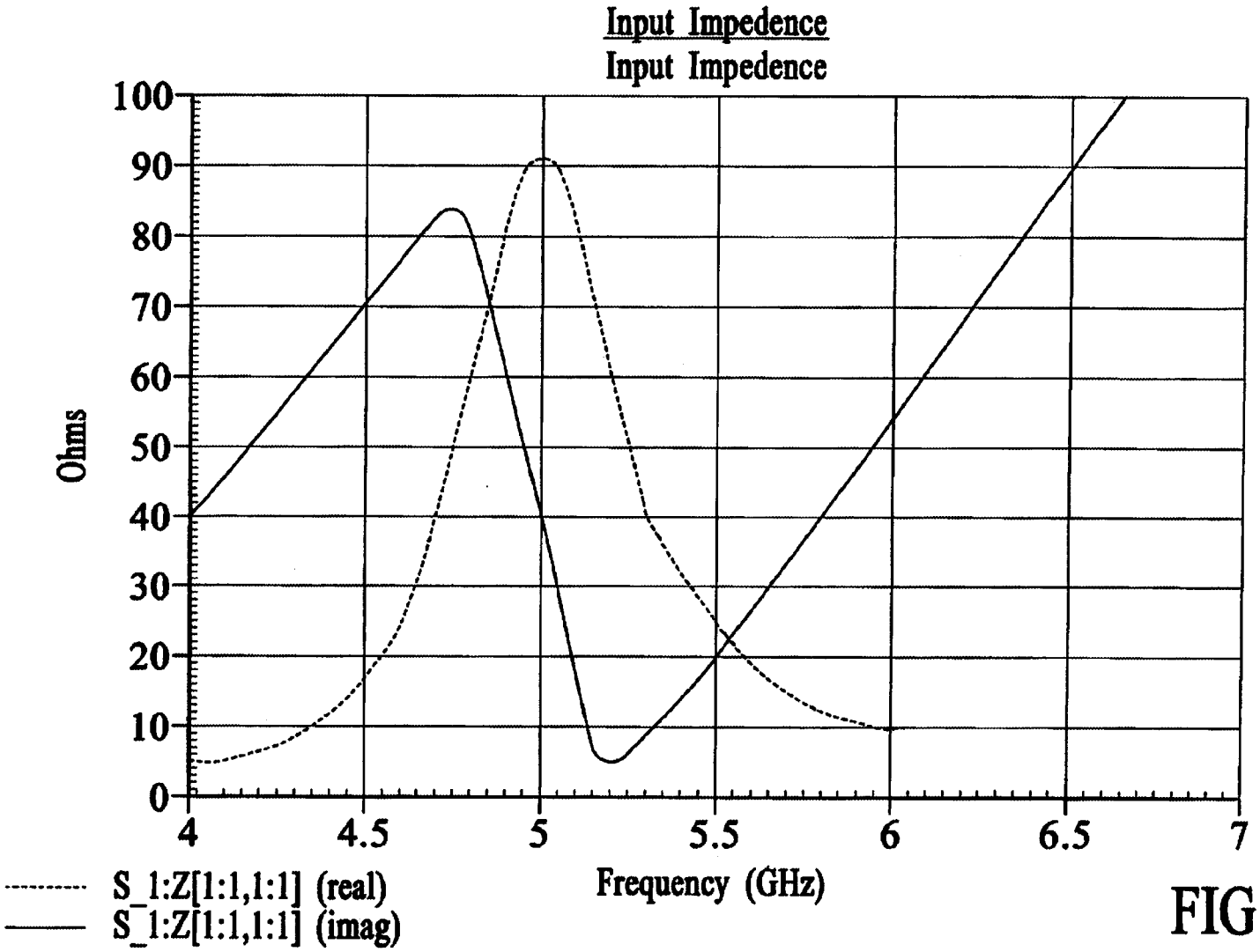
FIG. 28 is a graph illustrating performance characteristics relating to input impedance for an exemplary implementation of the exemplary antenna of FIG. 4.
Figure 29:
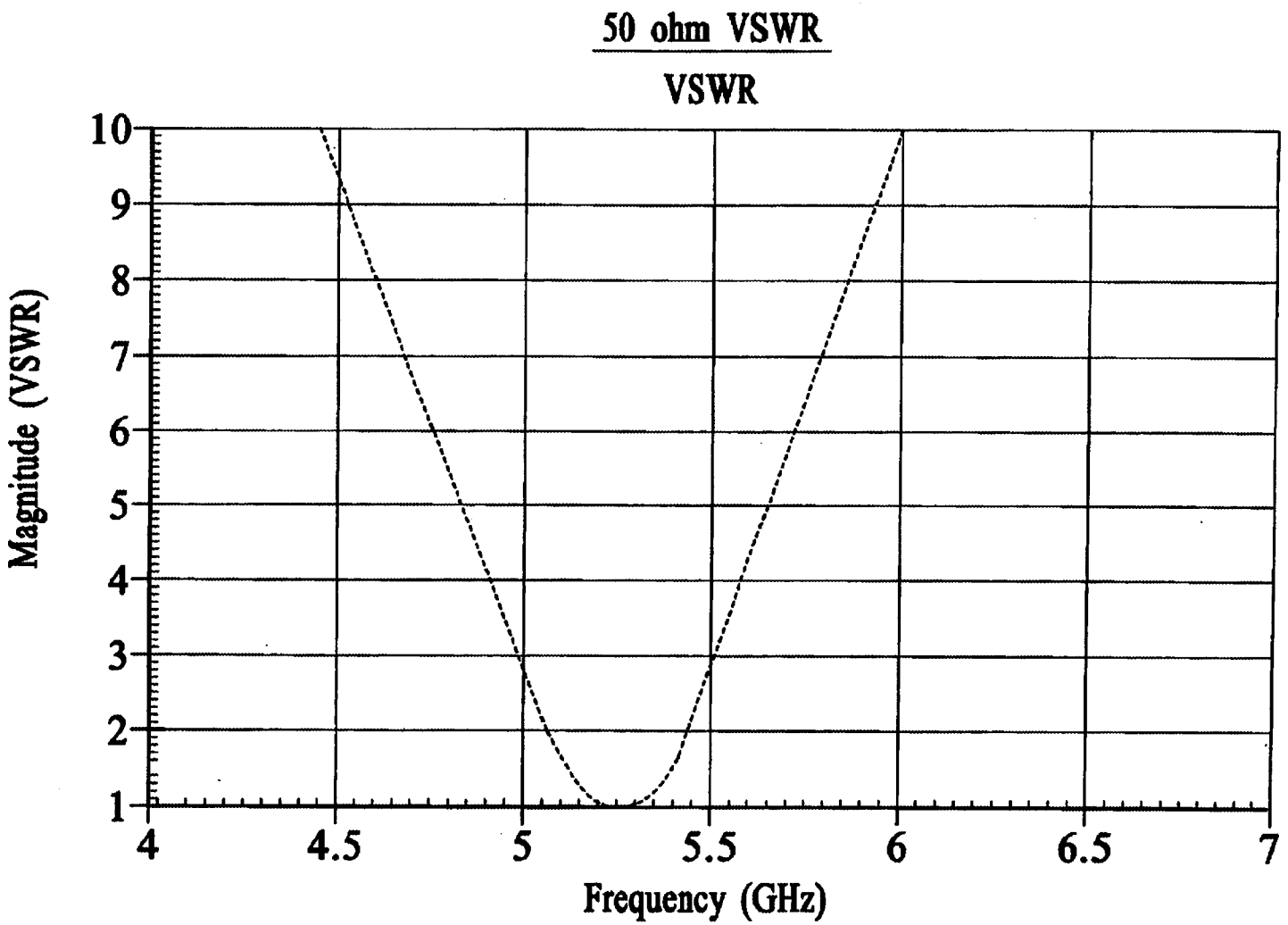
FIG. 29 is a graph illustrating performance characteristics relating to bandwidth for the exemplary implementation of the exemplary antenna of FIG. 4.
Figure 30:
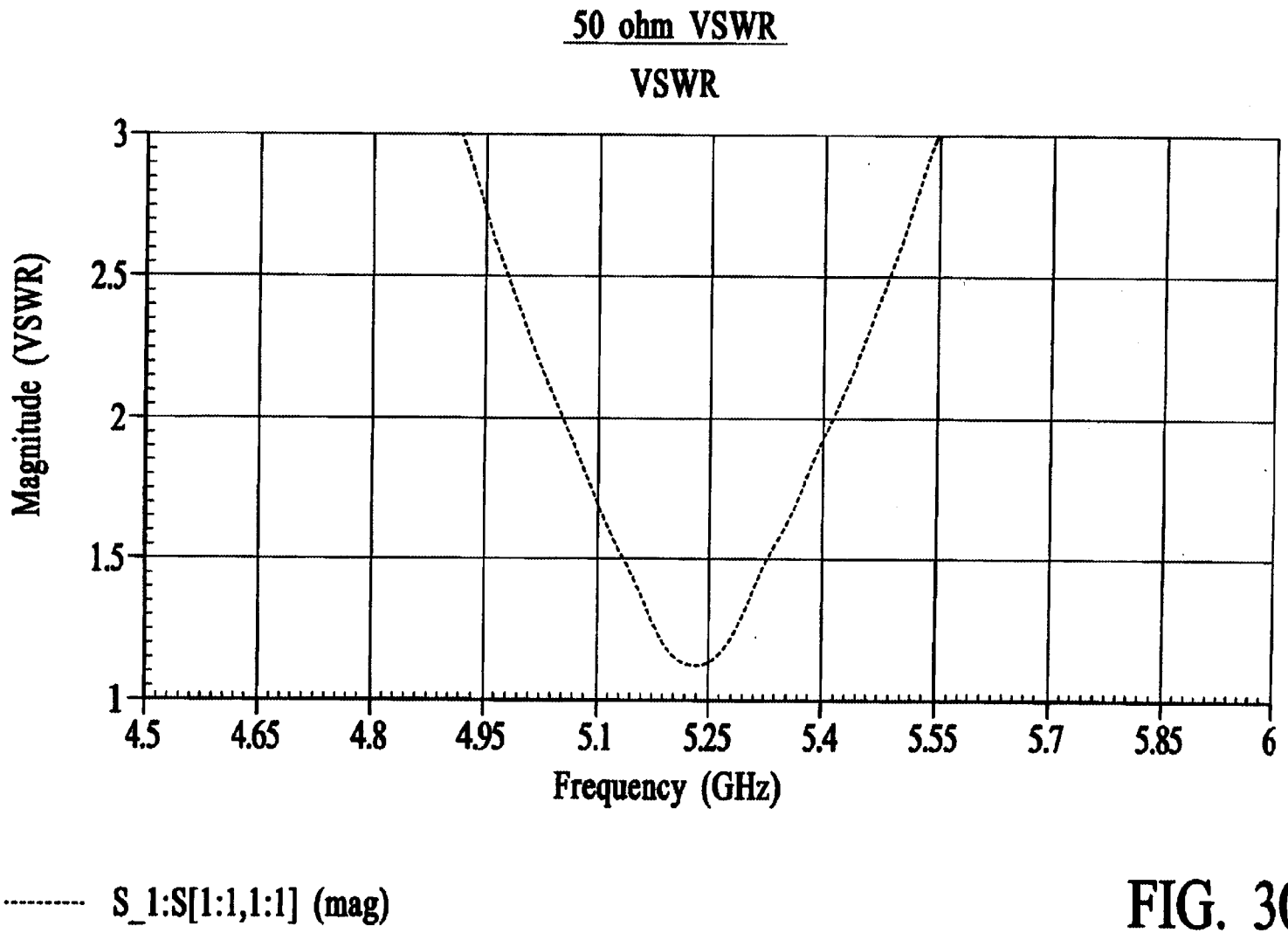
FIG. 30 is a magnified view of the graph of FIG. 29.

FIGS. 28–30 are graphs illustrating performance characteristics relating to input impedance and the bandwidth according to the exemplary implementation of the exemplary side stem antenna 200 of FIG. 4. In FIG. 28, the real and imaginary parts of the input impedance, in units of Ohms (Ω), of the antenna 200 on the vertical scale are plotted against frequency, in unit of GHz, on the horizontal scale. At the operating frequency $f$ of 5.25 GHz, the real part of the input impedance is approximately 50 Ω, so that the microstrip line 214 of the transmission feed 216, which has an impedance of 50 Ω as shown in Table I, is effectively matched by the antenna 200. In FIG. 29 the bandwidth of the antenna is shown with the magnitude of the voltage standing wave ratio (VSWR) plotted on the vertical scale against frequency on the horizontal scale. The bandwidth for a VSWR less than 3 is around 600 MHz, between 4.9 GHz and 5.5 GHz. FIG. 30 is a magnified portion of the graph in FIG. 29, focused so that the bandwidth for a VSWR less than 2 can more easily be discerned. The bandwidth for VSWR<2 is around 370 MHz, between 5.05 GHz and 5.42 GHz. In a neighborhood of the operating frequency $f$=5.25 GHz, the bandwidths are comparable to the bandwidths associated with a traditional top hat antenna, such as the top hat antenna 100 of FIG. 1.

Figure 5:
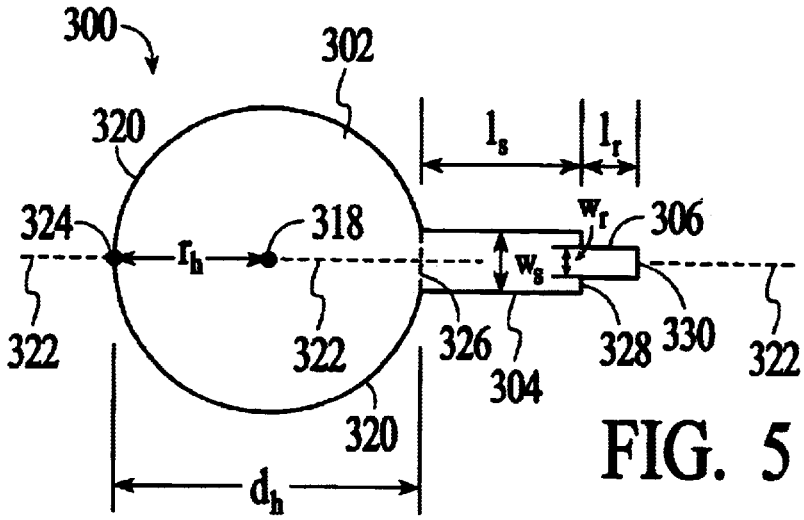
FIG. 5 is a diagram illustrating a top view of an exemplary continuous, unitary piece of material used to form an exemplary side stem antenna according to a second presently preferred embodiment.

Referring now to FIG. 5, it is a diagram illustrating a top view of an exemplary continuous, unitary piece of material 300 used to form an exemplary side stem antenna 300 according to a second presently preferred embodiment. As will be evident from inspection of FIG. 5, the antenna 300 is similar in nature to the antenna 200 and the description of the antenna 200 with regard to FIGS. 2–4, subject to the following additional commentary, will provide sufficient instruction to one skilled in the art. The exemplary side stem antenna 300 differs from the antenna 200 in that the material 300 used to form the antenna 300 includes a root area or root 306 rather than a foot area or foot 206. The root 306 has a length $l_r$ measured from an end 328 of a stem area or stem 304, at which the root 306 is joined to the stem 304, to an end 330 of the root 306. The root 306 has a width $w_r$ that, by definition of this embodiment, is preferably less than a width $w_s$ of the stem 304. That is, the width $w_s$ preferably exceeds the width $w_r$.

Figure 6:
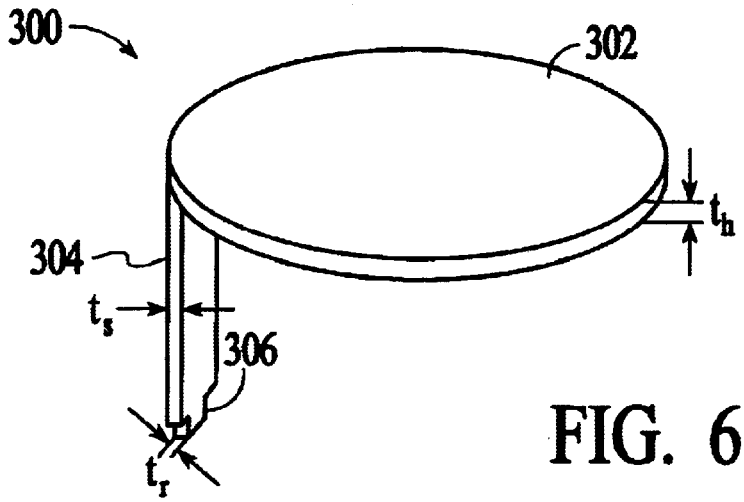
FIG. 6 is a diagram illustrating a three dimensional view of the exemplary unitary piece of material of FIG. 5 formed into the shape of the exemplary side stem antenna of FIG. 5.

In FIG. 6, the unitary piece of material 300 is bent into a shape capable of operating as an antenna. As shown in FIG. 6, preferably the unitary piece of material 300 is bent so that a hat area or hat 302 and the stem 304 are perpendicular to one another. Of course, the angle between the hat 302 and the stem 304 is variable and may be adjusted as suitable for performance or mechanical stability reasons, for example. Depending on the nature of the material 300 and a thickness $t_s$, $t_h$, $t_r$ of the material 300 that is used for the antenna 300, the root 304 may be bendable. However, by definition of this exemplary embodiment, the root 304 preferably does not bend at the end 328 at which the root 306 is joined to the stem 304, but rather remains flat and in the same plane as with the stem 304 as illustrated in FIG. 6.

Figure 7:
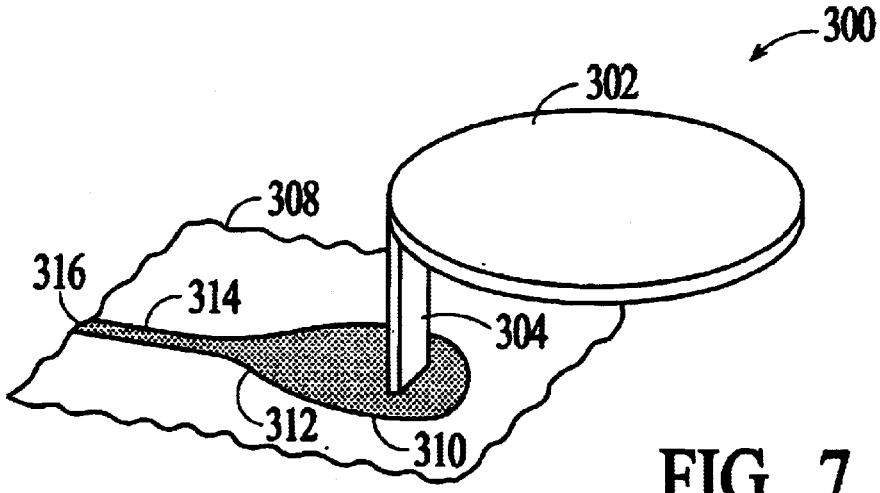
FIG. 7 is a diagram illustrating a three dimensional view of the exemplary side stem antenna of FIGS. 5–6 mounted on a printed circuit board.

FIG. 7 is a diagram illustrating a three dimensional view of the exemplary side stem antenna 300 of FIGS. 5–6 mounted on a PCB 308. The PCB 308 includes, for example, a substrate such as FR4® board, although other dielectric materials may be used as suitable. The stem 304 is preferably wider than the root 306 and the root 306 preferably lies in the same plane as the stem 304 for reasons that will become evident when viewing the antenna 300 of FIG. 7 and when reviewing the description below of mounting systems according to presently preferred embodiments. In FIG. 7, for example, the stem 304 is supported by a transmission feed 316 that is laid out along a top side of the PCB 308, while the root 304 penetrates the PCB 308 through to a bottom side of the PCB 308. The transmission feed 316 preferably includes a microstrip line 314, a taper region 312 and a connecting pad 310. Preferably, the transmission feed 316 is a microthin layer of metal film, such as copper, although other metals and conductive materials may be used as suitable. The connecting pad 310 is preferably semi-circular having a radius $r_p$ and is joined with the taper region 312. The connecting pad 310 may also be defined as a circle so that the taper region 312 and the connecting pad 310 overlap in terms of area. The root 304 and thus the antenna 300 are preferably secured to the PCB 308 by a process that solders or otherwise fuses the root 304 to the bottom of the PCB 308 as explained in more detail below with regard to FIGS. 15, 23, 20, and 27.

Figure 8:
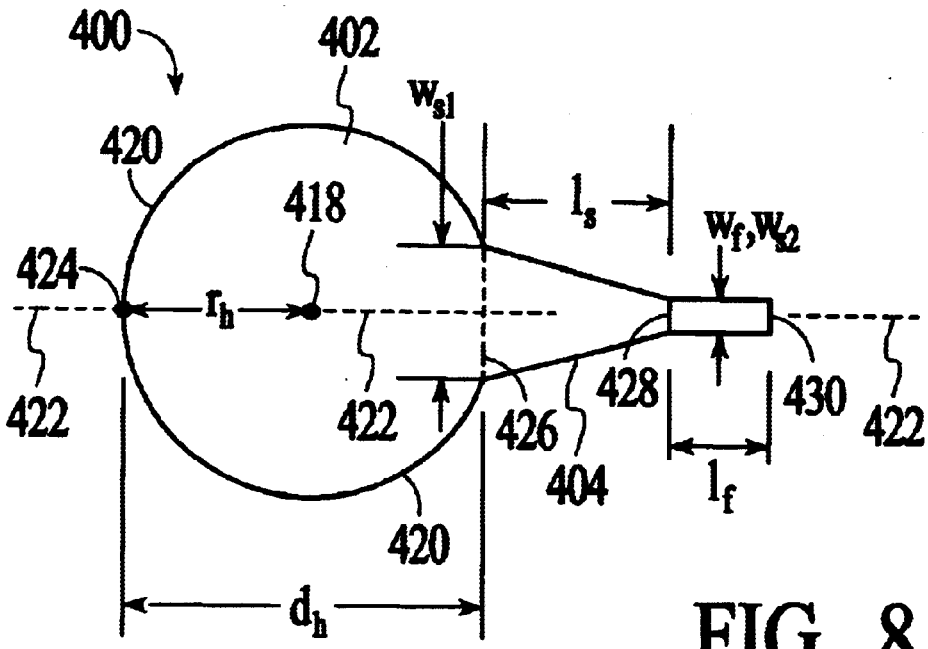
FIG. 8 is a diagram illustrating a top view of an exemplary continuous, unitary piece of material used to form an exemplary side stem antenna according to a third presently preferred embodiment.

Referring now to FIG. 8, it is a diagram illustrating a top view of an exemplary continuous, unitary piece of material 400 used to form an exemplary side stem antenna 400 according to a third presently preferred embodiment. As will be evident from inspection of FIG. 8, the antenna 400 is similar in nature to the antenna 200 and the description of the antenna 200 with regard to FIGS. 2–4, subject to the following additional commentary, will provide sufficient instruction to one skilled in the art. The exemplary side stem antenna 400 differs from the antenna 200 in that the material 400 used to form the antenna 400 includes a stem area or stem 404 that is gradually tapered from a first width $w_{s1}$ at a dotted line 426 at which the stem 404 is joined with a hat area or hat 402, to a second width $w_{s2}$ at a dotted line 428 at which the stem 404 is joined with a foot area or foot 406. The foot 406 has a width $w_f$ that, by definition of this embodiment, is preferably less than the width $w_{s1}$ of the stem 404, and is preferably equal to the width $w_{s2}$ of the stem 404. Therefore, the width $w_{s1}$ preferably exceeds the widths $w_{s2}$ and $w_f$. In some embodiments, simulations on exemplary side stem antennas mounted on printed circuit boards with a similarly tapered stem showed performance improvements with regard to bandwidth. The tapered stem in a PCB mounting environment exploits the electric field that expands gradually alongside from the base of the tapered stem closest to the PCB to the top of the stem at the hat of the side stem antenna.

Figure 9:
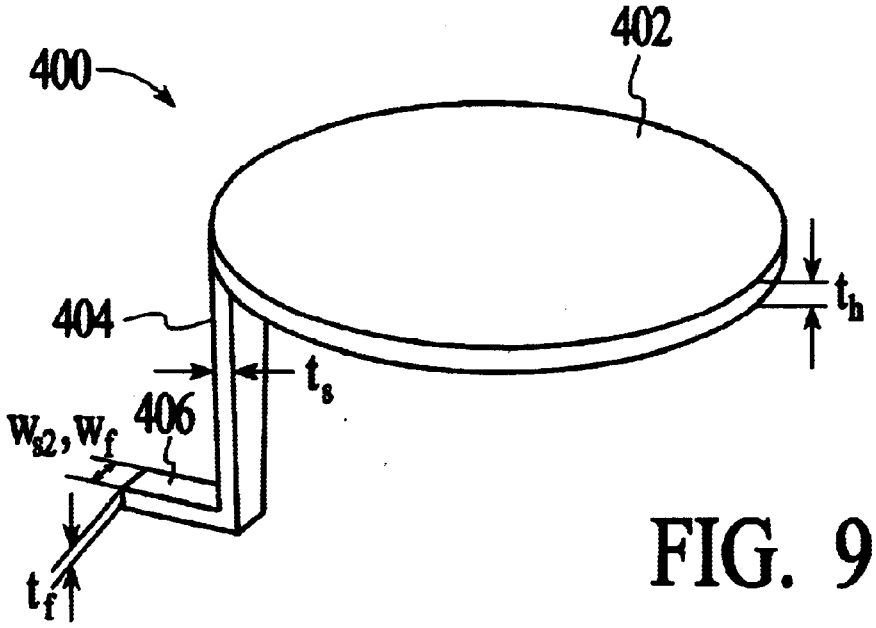
FIG. 9 is a diagram illustrating a three dimensional view of the exemplary unitary piece of material of FIG. 5 formed into the shape of the exemplary side stem antenna of FIG. 8.

In FIG. 9, the unitary piece of material 400 is bent into a shape capable of operating as an antenna. As shown in FIG.

9, preferably the unitary piece of material 400 is bent so that the hat 402 and the stem 404 are perpendicular to one another. Of course, the angle between the hat 402 and the stem 404 is variable and may be adjusted as suitable for performance or mechanical stability reasons, for example. Preferably the unitary piece 400 is bent so that the stem 404 and the foot 406 are perpendicular to one another. Of course, the angle between the stem 404 and the foot 406 is variable and may be adjusted as suitable for performance or mechanical stability reasons, for example.

The Central Stem, or Slotted Hat Antenna

Figure 10:
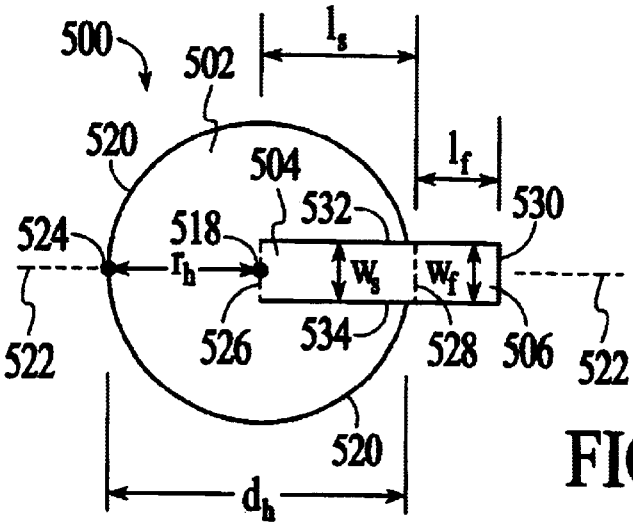
FIG. 10 is a diagram illustrating a top view of an exemplary continuous, unitary piece of material used to form an exemplary central stem, or slotted hat, antenna according to a fourth presently preferred embodiment.

Referring now to FIG. 10, it is a diagram illustrating a top view of an exemplary continuous, unitary piece of material 500 used to form an exemplary central stem, or slotted hat, antenna 500 according to a fourth presently preferred embodiment. The material 500 is illustrated prior to bending of the material 500 into a shape of the antenna 500. The unitary piece of material 500 includes a circular hat area or hat 502, a stem area or stem 504, and a foot area or foot 506. The circular hat area 502 includes a center 518 and an outer region 520 that extends along the portion of the perimeter of the material 500 that includes the circular hat area 502. The dimensional parameters of the antenna 500 include a diameter $d_h$ of the hat 502, a radius $r_h$ of the hat 502 that is preferably defined, for example, from the center 518 to a point 524 on the outer region 520 along a radial axis 522, a width $w_s$ of the stem 504, a width $w_f$ of the foot 506, a length $l_s$ of the stem 504, and a length $l_f$ of the foot 506. In a preferred embodiment, the length $l_f$ of the foot 506 is equivalent to the width $w_s$ of the stem 504 and to the width $w_f$ of the foot 506, although the relative dimensions of the antenna 500 may vary as suitable according to the particular application in which the antenna 500 is used.

The dotted lines 526, 528 in FIG. 10 are included for purposes of illustration to indicate the various areas 502, 504, 506 and to identify desired lines at which the unitary piece of material 500 is bendable, or may be bent, to form the slotted hat antenna 500. The material 500 may contain an impression or a ridge along a desired bending line, such as that identified by the dotted lines in FIG. 10, that aids in bending the material 500 into the shape of the antenna 500. The length $l_s$ of the stem 504 is defined between the dotted lines 526, 528. The stem 504 has a first side 532 and a second side 534. Preferably, the sides 532, 534 are defined by a process that stamps or cuts the stem 504 out of the circular hat 502 along the first side 532 and the second side 534. The stem 504 is joined with the center 518 of the circular hat 502 at the dotted line 526. Following the process of stamping or cutting, the stem 504 preferably remains joined with the center 518 of the hat 502 along the dotted line 526. The stem 504 protrudes outward from the center 518 along the radial axis 522. The unitary piece of material 500 is bendable, and thus an angle between the hat 502 and the stem 504 is adjustable, at the dotted line 526, so that when the stem 504 is bent, a rectangular slot 536 is left in the hat 502. The length $l_f$ of the foot 506 is defined between the dotted line 528 and an end 530 of the foot area 502 and of the material 500. The foot 506 is joined with the stem 504 at the dotted line 528. The unitary piece of material 500 is bendable, and thus an angle between the stem 504 and the foot 506 is adjustable, at the dotted line 528.

Figure 11:
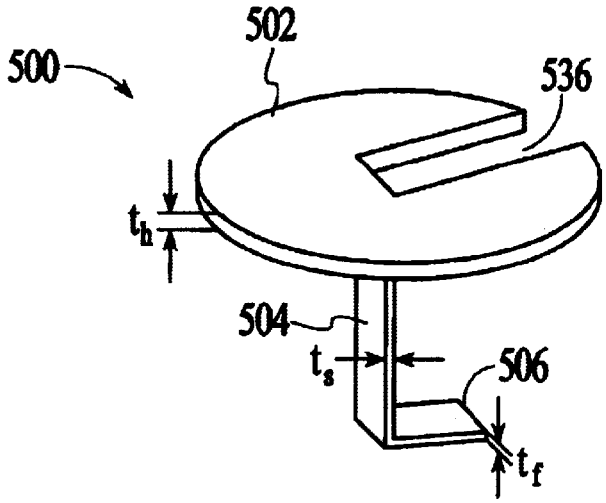
FIG. 11 is a diagram illustrating a three dimensional view of the exemplary unitary piece of material of FIG. 10 formed into the shape of the exemplary slotted hat antenna of FIG. 10.

FIG. 11 is a diagram illustrating a three dimensional view of the exemplary unitary piece of material 500, formed into the shape of the exemplary slotted hat antenna 500. The dimensional parameters of the antenna 500 further include a thickness $t_h$ of the circular hat 502, a thickness $t_s$ of the stem 504, and a thickness $t_f$ of the foot 506. In general, the unitary piece of material 500, and thus the slotted hat antenna 500, will have uniform thickness throughout the hat 502, stem 504, and foot 506 areas, although, of course, other thicknesses are possible. In a preferred embodiment, the material 500 is a metal material, such as copper, although any suitable conductive material may be used as suitable. The material 500 is preferably stamped out in the shape illustrated in FIG. 10 from a larger planar, flat, continuous, piece of material in a manufacturing process. Preferably, the material 500 is stamped out in accordance with the design dimensions of the slotted hat antenna 500. Any cutting or stamping process may be used as suitable to stamp out the material 500 from the larger piece. The larger piece of material will typically be available in standard widths from material manufacturers and a standard width may be chosen, for example, for mechanical stability purposes, for durability, or for bendability.

In FIG. 11, the unitary piece of material 500 is bent into a shape capable of operating as an antenna. As shown in FIG. 11, preferably the unitary piece of material 500 is bent so that the hat 502 and the stem 504 are perpendicular to one another, leaving the rectangular slot 536 in the hat 502. Of course, the angle between the hat 502 and the stem 504 is variable and may be adjusted as suitable for performance or mechanical stability reasons, for example. Preferably the unitary piece 500 is bent so that the stem 504 and the foot 506 are perpendicular to one another. Of course, the angle between the stem 504 and the foot 506 is variable and may be adjusted as suitable for performance or mechanical stability reasons, for example.

Preferably, the design dimensions of the antenna 500 are selected in accordance with the environment within which the antenna is intended to operate. For example, in a preferred embodiment, the design dimensions are selected according to an operating frequency, and a corresponding operating wavelength, or corresponding ranges of these, for the antenna 500.

Although selection of the design dimensions is a matter of design choice, as a designer must determine the relative importance of different performance criteria, some rules of thumb may accompany design intuition and numerical modeling of the design dimensions. For example, in a preferred embodiment, the desired length $l_s$ of the stem 504 of the slotted hat antenna 500 is approximately one-tenth to one-twelfth of the operating wavelength, or from $\lambda/10$ to $\lambda/12$, in the interest of minimizing the height of the antenna 500 above, for example, a PCB. Preferably, the height of the antenna 500 above the PCB is roughly equivalent to the length $l_s$ of the stem 504. A design rule of thumb to achieve the length $l_s$ and to maintain acceptable performance that is comparable to the traditional top hat antenna 100 illustrated in FIG. 1, is to make the radius $r_h$ of the hat 502 approximately equivalent to the length $l_s$ of the stem 504 so that (2) and (3) above are satisfied. In a preferred embodiment, the radius $r_h$ of the hat and the length $l_s$ of the stem are selected to satisfy (3) and to minimize $l_s$. For example, if the length $l_s$ is selected to be approximately equal to $\lambda/12$, then according to (3) the radius $r_h$ should be approximately equal to $\lambda/12$. As another example, if the length $l_s$ is selected to be approximately equal to $\lambda/10$, then to satisfy (3) the radius $r_h$ should be approximately equal to $\lambda/13$.

Figure 12:
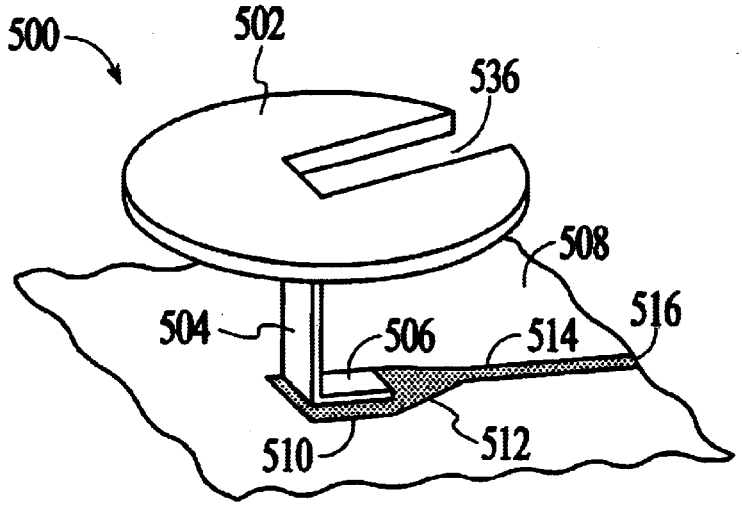
FIG. 12 is a diagram illustrating a three dimensional view of the exemplary slotted hat antenna of FIGS. 10–11 mounted on a printed circuit board.

The antenna 500 is capable of being mounted on a printed circuit board (PCB), as shown in FIG. 12. The antenna 500 of FIG. 12 is mounted on a PCB 508 and contacts a transmission feed 516 that is laid out along the top side of the PCB 508. The PCB 508 includes, for example, a substrate such as FR4® board, although other dielectric materials may be used as suitable. The transmission feed 516 preferably includes a microstrip line 514, a taper region 512, and a contact area or connecting pad 510. Preferably, the transmission feed 516 is a microthin layer of metal film, such as copper, although other metals and conductive materials may be used as suitable. FIG. 24 is a diagram illustrating a top view of the exemplary transmission feed 216 of FIG. 4 without the antenna 200. The exemplary transmission feed 216 is analogous to the exemplary transmission feed 516.

As can been seen from FIG. 12, the purpose of the foot 506 of the antenna 500 is to mount the antenna 500 on a surface, such as the PCB 508. Preferably, a process is used to solder, or otherwise fuse, the foot 506 of the antenna 500 to the PCB 508. The width $w_f$ and the length $l_f$ of the foot 506 are critical for mechanical stability of the antenna 500. The dimensions are preferably carefully selected using mechanical intuition and numerical simulation so that the foot 506 is long enough and the foot 506, and the stem 504 at its end nearest the foot 506, are wide enough to mechanically support the antenna 500 and maintain the antenna 500 in the position illustrated in FIG. 12, i.e., so that the hat 502 is parallel to the PCB 508. For example, if the length $l_f$ of the foot 506 is too short relative to the rest of the antenna 500, and provides no counterbalance to the stem 504 and the hat 506, the foot 506 may peel off from the connecting pad 510. Similarly, if the width $w_f$ of the foot 506 and the width $w_s$ of the stem is too thin relative to the hat, the antenna 500 may not be supported effectively, and may be prone to undesired bending or breaking.

The width $w_f$ of the foot 506, in turn, determines the width of the connecting pad 510 and the width of the taper region 512 where the taper region 512 joins with the connecting pad 510. The connecting pad 510 is preferably used to make electrical contact with the foot 506 and thus the antenna 500, and to provide a surface onto which the foot 506 and the antenna 500 may be soldered. The microstrip line 514, as is commonly known in the art, is a structure that behaves like a transmission line at microwave frequencies and that transmits electrical signals in conjunction with a dielectric layer and a ground plane, in this case with the PCB 508. For a given width, such as width $w_m$, of microstrip line and a given height of the microstrip line above a ground plane, typically the thickness of the PCB layer, there is an impedance associated with the microstrip line. Preferably, the taper region 512 is used to match the input impedance of the antenna 500 with the microstrip line 514. The length of the taper region 512 is dependent on how abrupt a transformation of the microstrip line 514 to the connecting pad 510 is acceptable for a particular application. The tradeoff for this parameter is between reducing the length of the transmission feed 516 to save area on the PCB 508 and avoiding unwanted reflections that can result from a more abrupt transformation along the taper region 512 from the width of the microstrip line 514 to the width of the connecting pad 510. The length of the connecting pad 510 preferably is determined according to the length of the foot 506.

The rectangular slot 536 in the circular hat 502 has implications for the performance of the slotted hat antenna 500. The current in a typical top hat antenna, such as the traditional top hat antenna 100 of FIG. 1 spreads radially outward in all directions equally over the circular hat 104. If the rectangular slot 536 of material is removed from the circular hat 502, there is a higher concentration of current around the slot 536. So the slot width, that is, the width $w_s$ of the stem 504, is one of the parameters that must be selected with care. If too much width $w_s$ is selected for the stem 504, the rectangular slot 536 in the hat 502 will be too wide and the resulting antenna 500 will suffer from a lack of rotational symmetry. In general, the narrower the stem 504, the narrower the slot 536, and the better the performance of the antenna 500. If too small a width $w_s$ is selected for the stem 504, the antenna 500 will be less stable mechanically. In addition, a mass production process that utilizes current technology to manufacture the antenna 500, the process of stamping out, or cutting, the stem 504 along the sides 532, 534 is problematic. The smaller the width $w_s$ of the stem 504 that is sought in production, the more likely that errors will occur, such as the stem 504 being inadvertently cut off. Since the stem 504 is not discarded from the stamping out or cutting process, but rather is used in the antenna 500, the width $w_s$ is a critical parameter that is limited by the process in question. A rule of thumb for selecting the stem 504 width $w_s$ in the antenna 500 is to attempt to select the minimum stem 504 width $w_s$, for performance purposes, that provides both mechanical stability and support for the antenna 500 and that provides enough margin of error for current stamping out and cutting processes.

Figure 13:
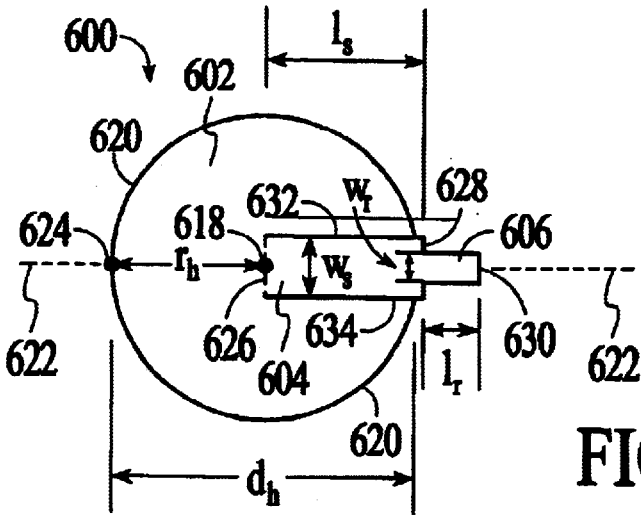
FIG. 13 is a diagram illustrating a top view of an exemplary continuous, unitary piece of material used to form an exemplary central stem, or slotted hat, antenna according to a fifth presently preferred embodiment.

Referring now to FIG. 13, it is a diagram illustrating a top view of an exemplary continuous, unitary piece of material 600 used to form an exemplary slotted hat antenna 600 according to a fifth presently preferred embodiment. As will be evident from inspection of FIG. 5, the antenna 600 is similar in nature to the antenna 500 and the description of the antenna 500 with regard to FIGS. 10–12, subject to the following additional commentary, will provide sufficient instruction to one skilled in the art. The exemplary slotted hat antenna 600 differs from the antenna 500 in that the material 600 used to form the antenna 600 includes a root area or root 606 rather than a foot area or foot 506. The root 606 has a length $l_r$ measured from an end 628 of a stem area or stem 604, at which the root 606 is joined to the stem 604, to an end 630 of the root 606. The root 606 has a width $w_r$ that, by definition of this embodiment, is preferably less than a width $w_s$ of the stem 604. That is, the width $w_s$ preferably exceeds the width $w_r$.

Figure 14:
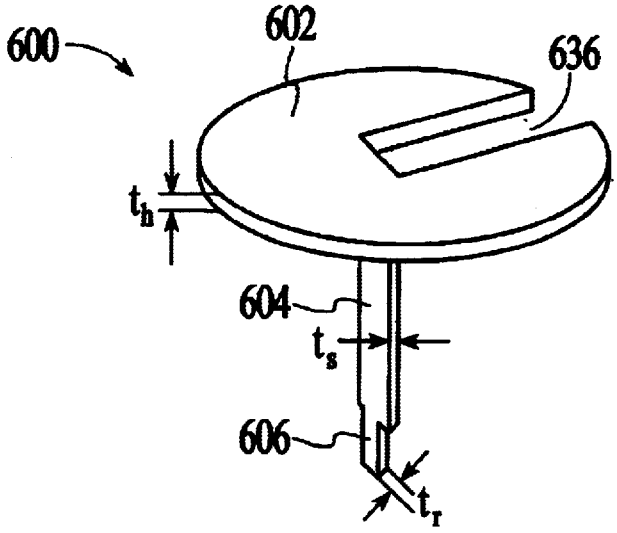
FIG. 14 is a diagram illustrating a three dimensional view of the exemplary unitary piece of material of FIG. 13 formed into the shape of the exemplary slotted hat antenna of FIG. 13.

In FIG. 14, the unitary piece of material 600 is bent into a shape capable of operating as an antenna. As shown in FIG. 14, preferably the unitary piece of material 600 is bent so that a hat area or hat 602 and the stem 604 are perpendicular to one another. Of course, the angle between the hat 602 and the stem 604 is variable and may be adjusted as suitable for performance or mechanical stability reasons, for example. Depending on the nature of the material 600 and a thickness $t_s$, $t_h$, $t_r$ of the material 600 that is used for the antenna 600, the root 604 may be bendable. However, by definition of this exemplary embodiment, the root 604 preferably does not bend at the end 628 at which the root 606 is joined to the stem 604, but rather remains flat and in the same plane as with the stem 604 as illustrated in FIG. 14.

Figure 15:
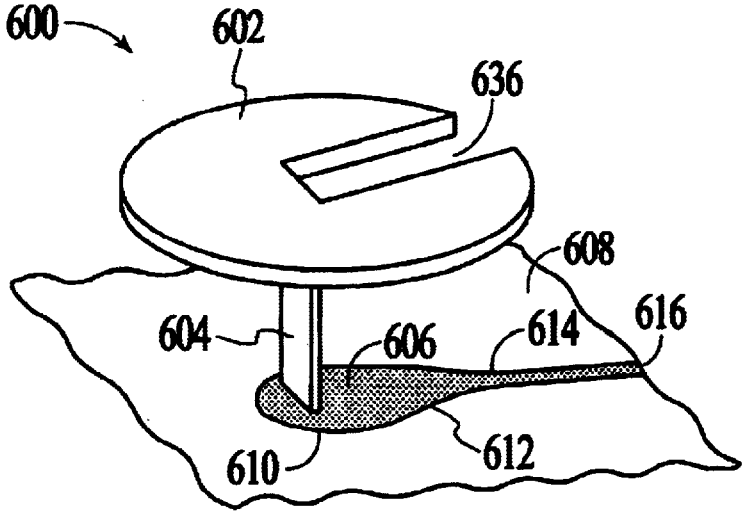
FIG. 15 is a diagram illustrating a three dimensional view of the exemplary slotted hat antenna of FIGS. 13–14 mounted on a printed circuit board.
Figure 23:
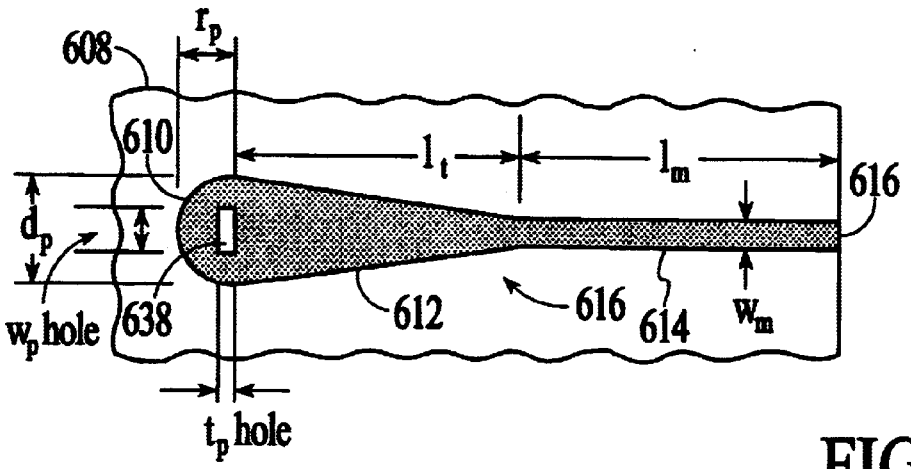
FIG. 23 is a diagram illustrating a top view of an exemplary transmission feed according to FIG. 15.

FIG. 15 is a diagram illustrating a three dimensional view of the exemplary slotted hat antenna 600 of FIGS. 13–14 mounted on a PCB 608. The PCB 608 includes, for example, a substrate such as FR4® board, although other dielectric materials may be used as suitable. The stem 604 is preferably wider than the root 606 and the root 606 preferably lies in the same plane as the stem 604 for reasons that will become evident when viewing the antenna 600 of FIG. 15 and when reviewing the description below of mounting systems according to presently preferred embodiments. In FIG. 15, for example, the stem 604 is supported by a transmission feed 616 that is laid out along a top side of the PCB 608, while the root 604 penetrates the PCB 608 through to a bottom side of the PCB 608. The transmission feed 616 preferably includes a microstrip line 614, a taper region 612 and a contact area or connecting pad 610. Preferably, the transmission feed 616 is a microthin layer of metal film, such as copper, although other metals and conductive materials may be used as suitable. FIG. 23 is a diagram illustrating a top view of the exemplary transmission feed 616 without the antenna 600. The exemplary transmission feed 616 is also analogous to the exemplary transmission feed 316. The connecting pad 610 of FIGS. 15, 23 is preferably semi-circular having a radius $r_p$ and is joined with the taper region 612. The connecting pad 610 may also be defined as a circle so that the taper region 612 and the connecting pad 610 overlap in terms of area. The root 604 and thus the antenna 600 are preferably secured to the PCB 608 by a process that solders or otherwise fuses the root 604 to the bottom of the PCB 608 as explained in more detail below.

The width $w_r$ of the root 606 and preferably the width $w_s$ of the stem 604 determine the radius $r_p$ and the diameter $d_p$ of the connecting pad 610 and the width of the taper region 612 where the taper region 612 joins with the connecting pad 610. The connecting pad 610 is preferably used to make electrical contact with the root 606 and thus the antenna 600, and to provide a surface to support the stem 604 and thus the antenna 600. Preferably, the root 606 penetrates the connecting pad 610 through a pad hole 638. Preferably, the pad hole 638 is shaped to firmly and tightly surround the root 606 to facilitate the electrical contact between the connecting pad 610 and the root 606. The width $w_{phole}$ of the pad hole 638 is preferably equivalent to the width $w_r$ of the root 606. The microstrip line 614, as is commonly known in the art, is a structure that behaves like a transmission line at microwave frequencies and that transmits electrical signals in conjunction with a dielectric layer and a ground plane, in this case with the PCB 608. For a given width, such as width $w_m$, of microstrip line and a given height of the microstrip line above a ground plane, typically the thickness of the PCB layer, there is an impedance associated with the microstrip line. Preferably, the taper region 612 is used to match the input impedance of the antenna 600 with the microstrip line 614. The length $l_t$ of the taper region 612 is dependent on how abrupt a transformation of the microstrip line 614 to the connecting pad 610 is acceptable for a particular application. The tradeoff for this parameter is between reducing the length $l_{feed}$ of the transmission feed 616 to save area on the PCB 608 and avoiding unwanted reflections that can result from a more abrupt transformation from the width $w_m$ of the microstrip line 614 to the width of the taper region 612 where the taper region 612 joins with the connecting pad 610.

Table II shows the results of a computer simulation run using a standard antenna design simulation software package, as well as the assumed values for various dimensions of an exemplary slotted hat antenna 600 implemented as in FIG. 15. The values for the dimensions of the exemplary slotted hat antenna 600 were obtained through iterative optimization using the software package. A exemplary prototype implementation of the slotted hat antenna 600 of FIG. 15 utilizes FR4® board as the dielectric material for the PCB 608. Some of the exemplary dimensions in Table II relate to a particular mounting system, shown in FIG. 27 and described in more detail below, that was used in which the root 606 of the antenna 600 penetrated the PCB 608 and was soldered to the PCB 608 at the bottom side of the PCB 608.

TABLE II

Figure 27:
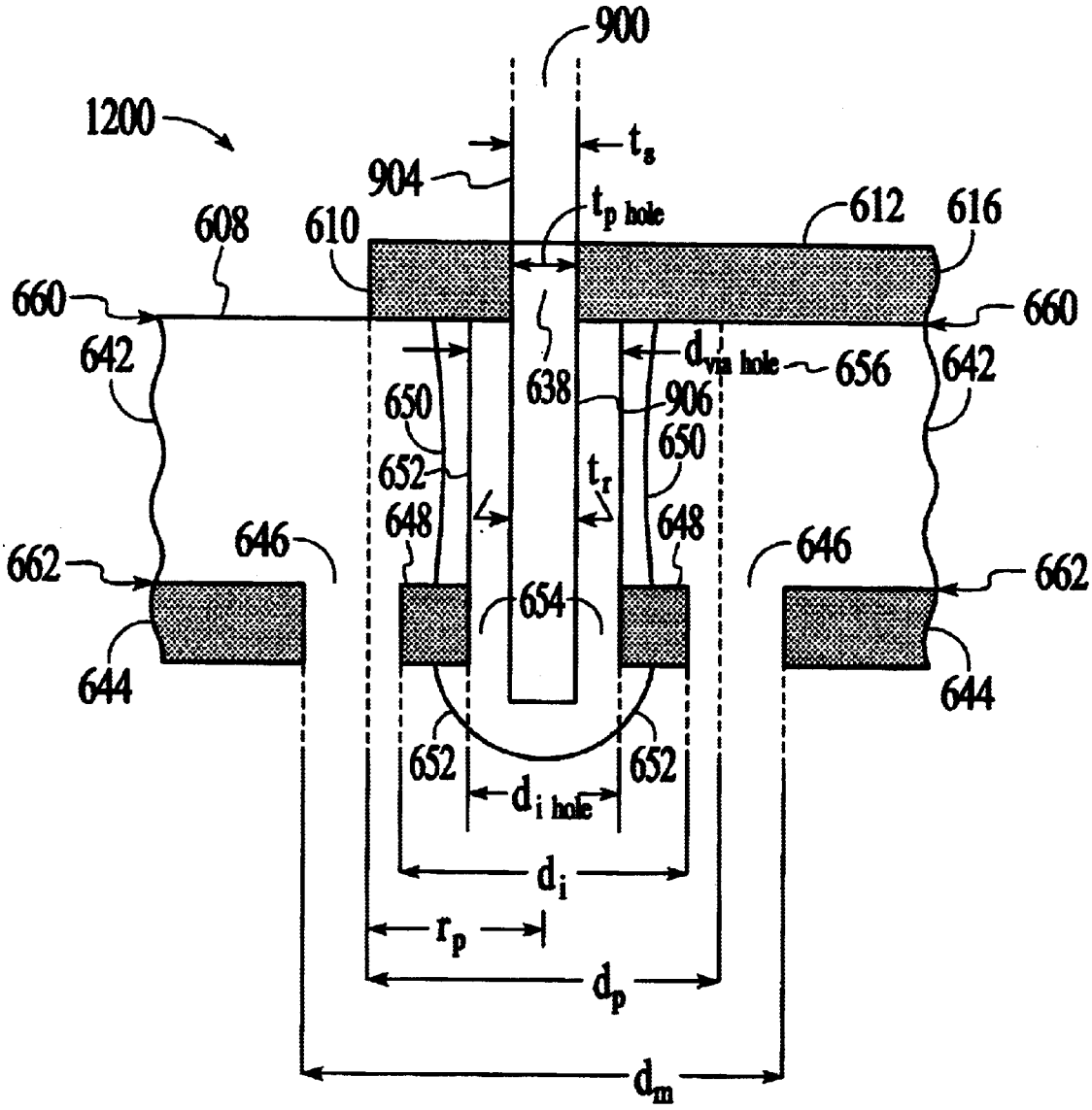
FIG. 27 is a diagram illustrating a side view of an exemplary mounting system, built into a printed circuit board according to an ninth presently preferred embodiment, to mount the exemplary antenna of FIG. 20.

Simulation results for an exemplary implementation of the exemplary slotted hat antenna 600 with root 606 of FIG. 15; including dimensions of the exemplary transmission feed 616 of FIGS. 15, 23 and 27, and dimensions of the exemplary mounting system 1200 of FIG. 27.

| Element/Dimension | Value |
|---|---|
| Operating Frequency | 5.25 GHz |
| Material 600 Thickness $t_h$, $t_s$, $t_r$; Thickness of Connecting Pad Hole 638 $t_{phole}$ | 0.2 mm |
| Diameter of Hat 602 $d_h$; $2r_h$ | 9 mm |
| Length of Stem 604 $l_s$, ≈ Height above PCB 608 | 4.6 mm $\left[d_h = 2r_h \approx 2l_s;\ d_h + l_s = 2r_h + l_s \approx \frac{\lambda}{4}\right]$ |
| Width of Stem 604 $w_s$ | 1.9 mm |
| Width of Root 606 $w_r$; Width of Connecting Pad Hole 638 $w_{phole}$ | 0.815 mm |
| Length of Root 606 $l_r$ | can vary; longer than PCB 608 thickness |
| Length of Transmission Feed 616 | 13.6 mm $[l_{feed} = r_p + l_t + l_m]$ |
| Thickness of Transmission Feed 616 | 0.07 mm (70 $\mu$m) |
| Impedance of Microstrip Line 614 | 50 Ω |
| Width of Microstrip Line 614 $w_m$ | 0.45 mm |
| Length of Microstrip Line 614 $l_m$ | 5.88 mm |
| Length of Taper Region 612 $l_t$ | 6.52 mm |
| Diameter of Connecting Pad 610 $d_p$; $2r_p$ | 2.4 mm |
| Diameter of Island 648 $d_i$ | 2 mm |
| Diameter of Island Hole 654 $d_{ihole}$ | 1 mm |
| Diameter of Via Hole 656 $d_{viahole}$ | 1 mm |
| Outer Diameter of Moat 646 (Ground Plane 644 Gap) $d_m$ | 2.4 mm |
| FR4 ® board (PCB 608) | $\epsilon_R \approx 4.25$ |

Figure 31:
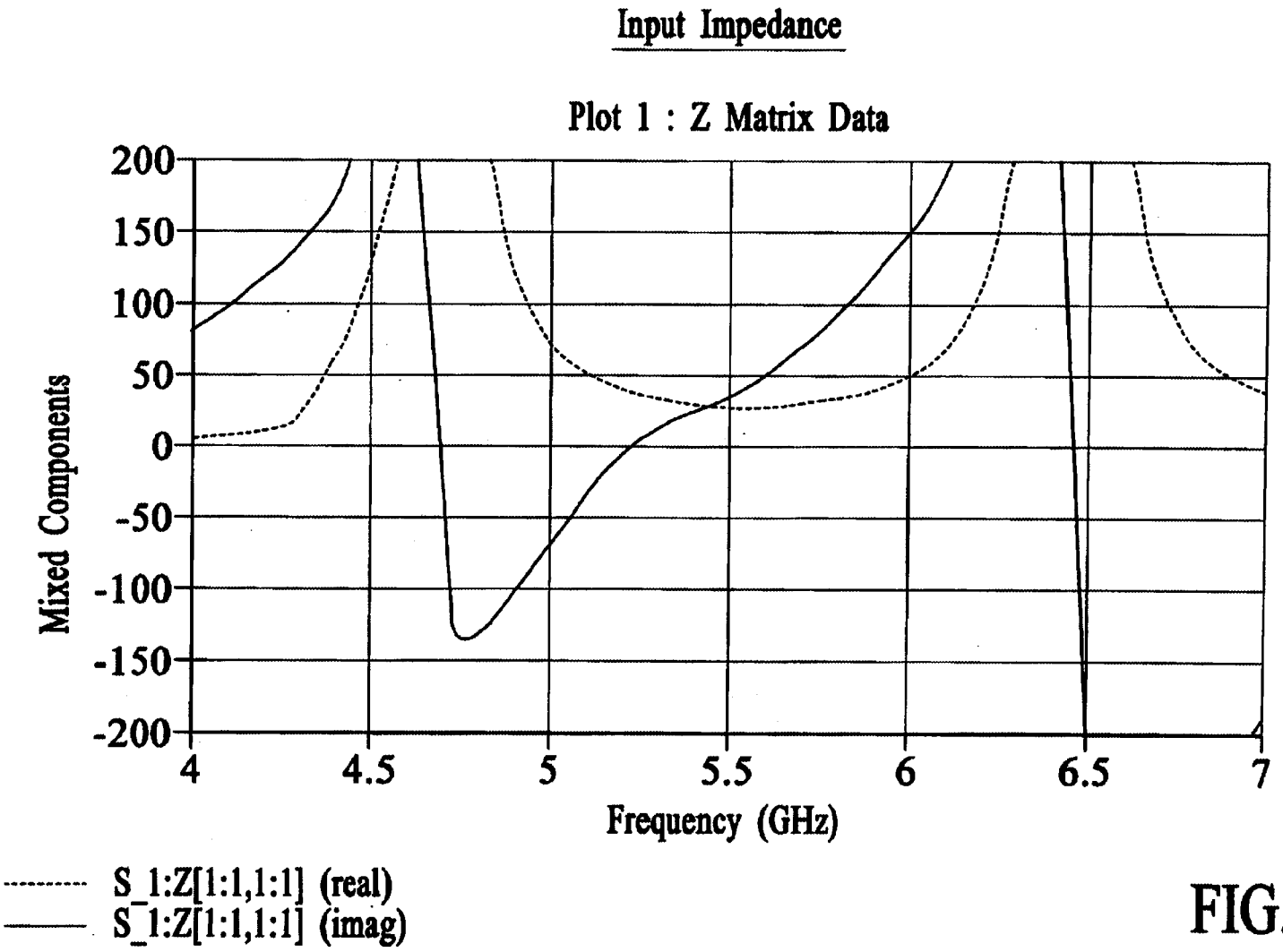
FIG. 31 is a graph illustrating performance characteristics relating to input impedance for an exemplary implementation of the exemplary antenna of FIG. 15.
Figure 32:
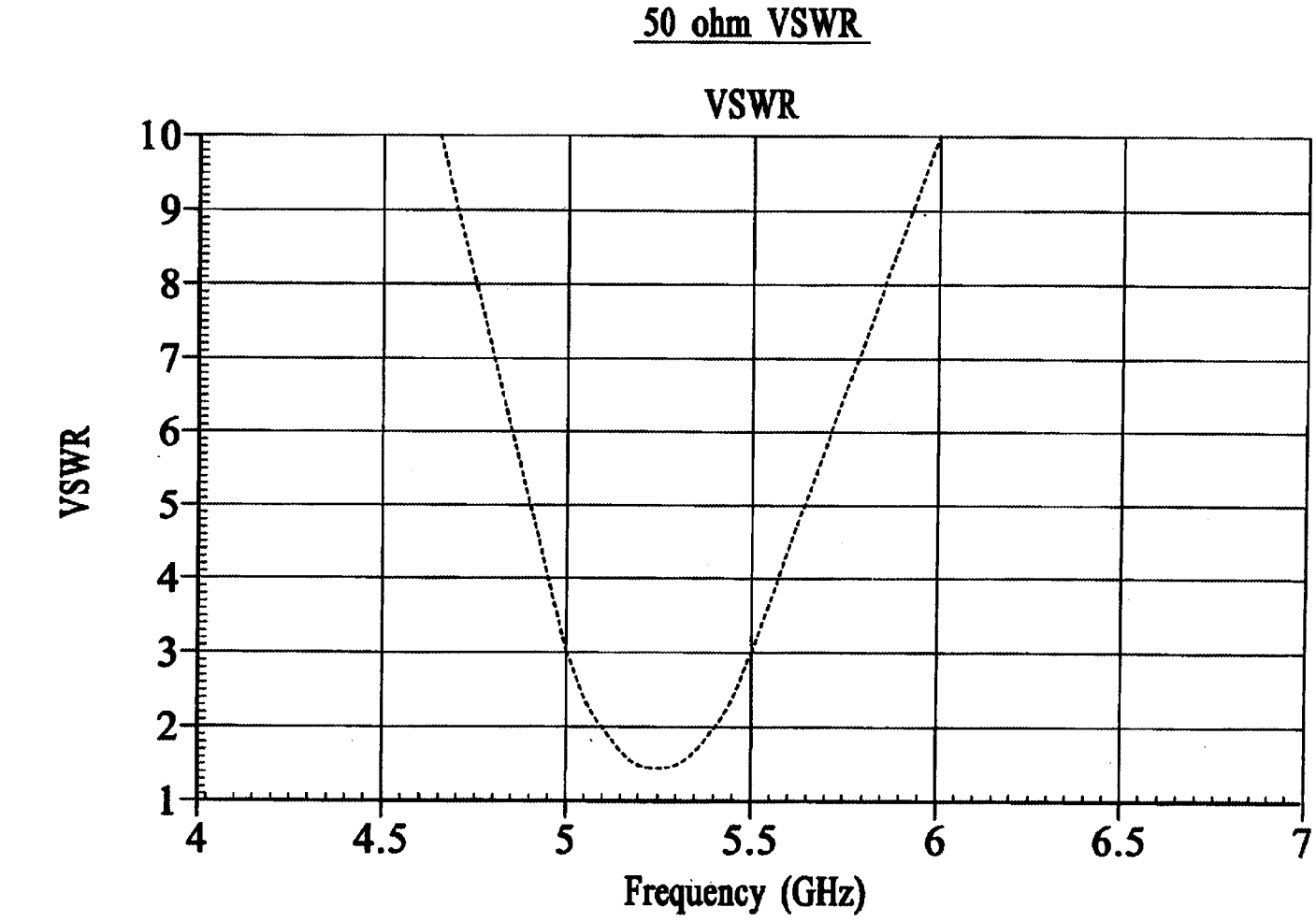
FIG. 32 is a graph illustrating performance characteristics relating to bandwidth for the exemplary implementation of the exemplary antenna of FIG. 15.
Figure 33:
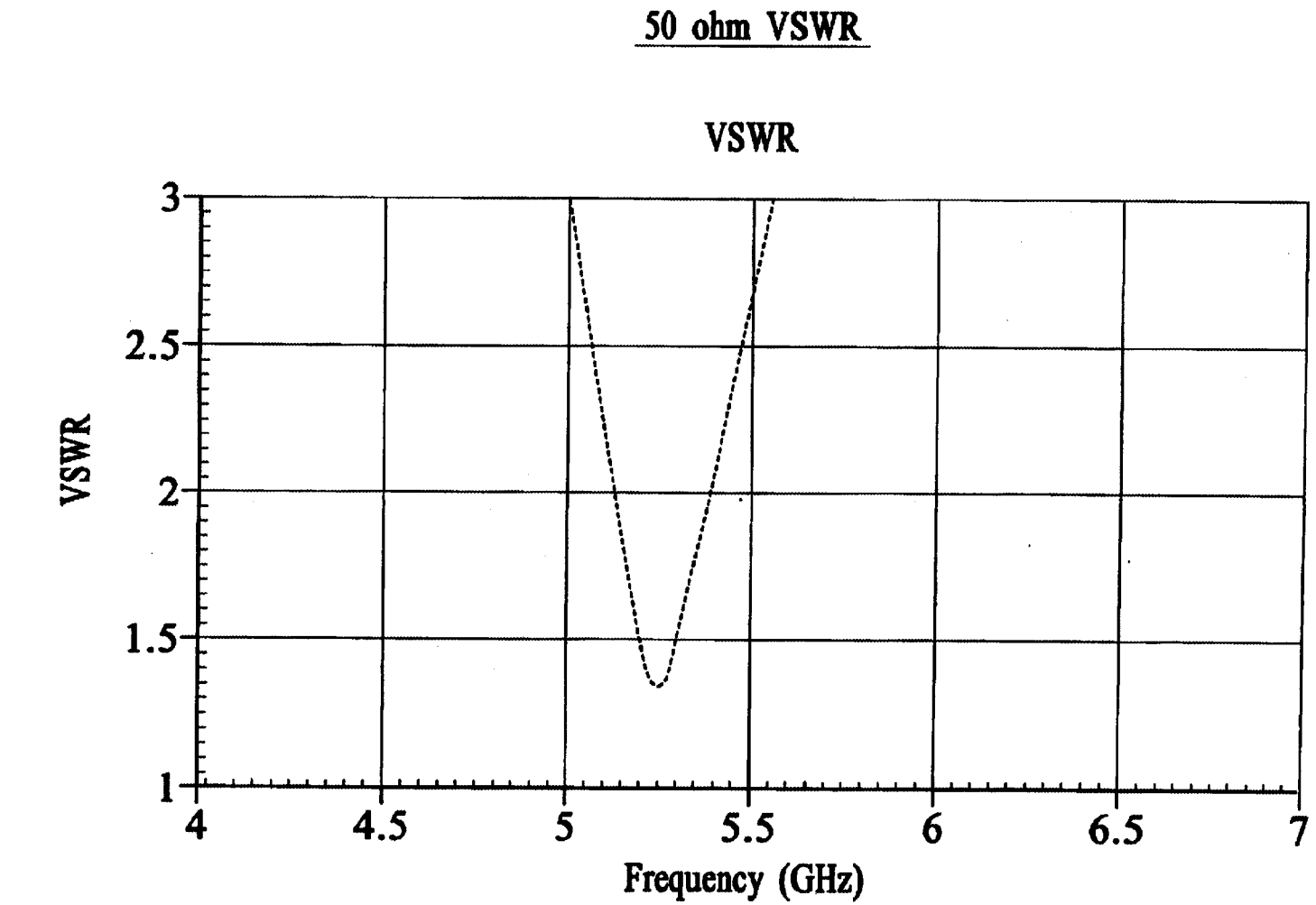
FIG. 33 is a magnified view of the graph of FIG. 32.

FIGS. 31–33 are graphs illustrating performance characteristics relating to input impedance and the bandwidth according to the exemplary implementation of the exemplary slotted hat antenna 600 of FIG. 15. In FIG. 31, the real and imaginary parts of the input impedance, in units of Ohms (Ω), of the antenna 600 on the vertical scale are plotted against frequency, in unit of GHz, on the horizontal scale. At the operating frequency $f$ of 5.25 GHz, the real part of the input impedance is around 35 Ω, so that the microstrip line 614 of the transmission feed 616, which has an impedance of 50 Ω as shown in Table II, is effectively matched by the antenna 600 in the neighborhood of the operating frequency. In FIG. 32 the bandwidth of the antenna is shown with the magnitude of the voltage standing wave ratio (VSWR) plotted on the vertical scale against frequency on the horizontal scale. The bandwidth for a VSWR less than 3 is around 500 MHz, between 5.0 GHz and 5.5 GHz. FIG. 33 is a magnified portion of the graph in FIG. 32, focused so that the bandwidth for a VSWR less than 2 can more easily be discerned. The bandwidth for VSWR<2 is around 300 MHz, between 5.1 GHz and 5.4 GHz. In a neighborhood of the operating frequency $f$=5.25GHz, the bandwidths are comparable to the bandwidths associated with a traditional top hat antenna, such as the top hat antenna 100 of FIG. 1.

Figure 16:
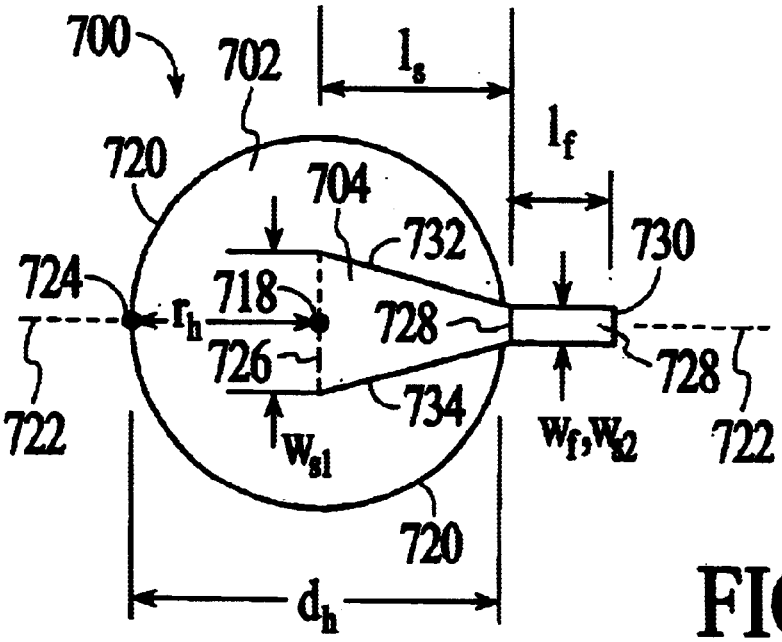
FIG. 16 is a diagram illustrating a top view of an exemplary continuous, unitary piece of material used to form an exemplary central stem, or slotted hat, antenna according to a sixth presently preferred embodiment.

Referring now to FIG. 16, it is a diagram illustrating a top view of an exemplary continuous, unitary piece of material 700 used to form an exemplary slotted hat antenna 700 according to a sixth presently preferred embodiment. As will be evident from inspection of FIG. 16, the antenna 700 is similar in nature to the antenna 200 and the description of the antenna 200 with regard to FIGS. 10–12, subject to the following additional commentary, will provide sufficient instruction to one skilled in the art. The exemplary slotted hat antenna 700 differs from the antenna 200 in that the material 700 used to form the antenna 700 includes a stem area or stem 704 that is gradually tapered from a first width $w_{s1}$ at a dotted line 726 at a center 718 of the a hat area or hat 702 at which the stem 704 is joined with the hat 702, to a second width $w_{s2}$ at a dotted line 728 at which the stem 704 is joined with a foot area or foot 706. The foot 706 has a width $w_f$ that, by definition of this embodiment, is preferably less than the width $w_{s1}$ of the stem 704, and is preferably equal to the width $w_{s2}$ of the stem 704. Therefore, the width $w_{s1}$ preferably exceeds the widths $w_{s2}$ and $w_f$. In some embodiments, simulations on exemplary slotted hat antennas mounted on printed circuit boards with a similarly tapered stem showed performance improvements with regard to bandwidth. The tapered stem in a PCB mounting environment exploits the electric field that expands gradually alongside from the base of the tapered stem closest to the PCB to the top of the stem at the hat of the slotted hat antenna.

Figure 17:
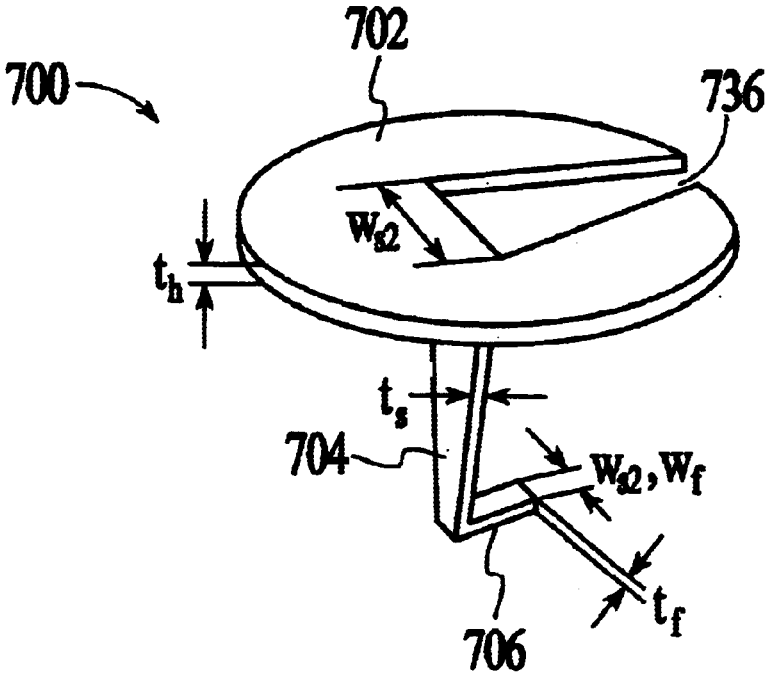
FIG. 17 is a diagram illustrating a three dimensional view of the exemplary unitary piece of material of FIG. 16 formed into the shape of the exemplary slotted hat antenna of FIG. 16.

In FIG. 17, the unitary piece of material 700 is bent into a shape capable of operating as an antenna. As shown in FIG. 9, preferably the unitary piece of material 700 is bent so that the hat 702 and the stem 704 are perpendicular to one another. Of course, the angle between the hat 702 and the stem 704 is variable and may be adjusted as suitable for performance or mechanical stability reasons, for example. Preferably the unitary piece 700 is bent so that the stem 704 and the foot 706 are perpendicular to one another. Of course, the angle between the stem 704 and the foot 706 is variable and may be adjusted as suitable for performance or mechanical stability reasons, for example.

The Modified Top Hat Antenna

Figure 18:
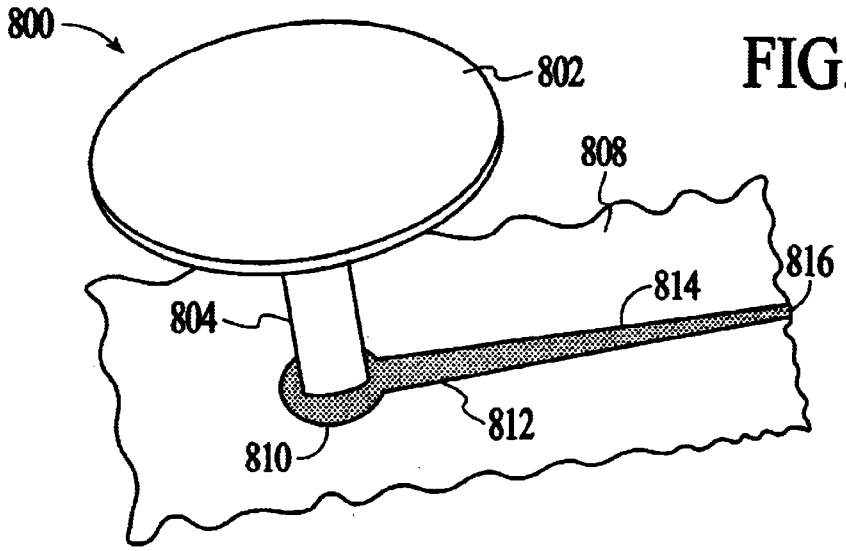
FIG. 18 is a diagram illustrating a three dimensional view of an exemplary top hat antenna, according to a seventh presently preferred embodiment, mounted on a printed circuit board.
Figure 19:
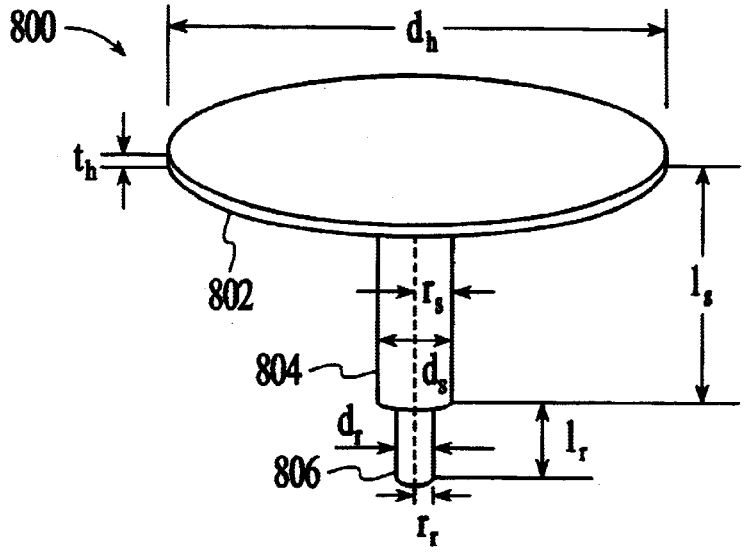
FIG. 19 is a diagram illustrating the exemplary top hat antenna of FIG. 18.

Referring now to FIG. 18, it is a diagram illustrating a three dimensional view of an exemplary top hat antenna 800, according to a seventh presently preferred embodiment, mounted on a PCB 808. The PCB 808 includes, for example, a substrate such as FR4® board, although other dielectric materials may be used as suitable. FIG. 19 is a diagram illustrating the exemplary top hat antenna 800 of FIG. 18. The exemplary top hat antenna 800 is a modified version of the traditional top hat antenna 100 of FIG. 1. The modified top hat antenna 800 includes a disk or circular hat 802, a cylindrical stem 804, and a cylindrical root 808. The stem 804, the circular hat 802 , and the root 806 are distinct pieces that are fused together via any of a series of well-known manufacturing processes to realize the modified top hat antenna 800. In a preferred embodiment, the antenna 800 is made of a metal, such as copper, although any suitable conductive material may be used as suitable.

The dimensional parameters of the antenna 800 include a thickness $t_h$ of the hat 802, a diameter $d_h$ of the hat 802, a radius $r_h$ of the hat 802, a length $l_s$ of the stem 804, a diameter $d_s$ of the stem 804, a radius $r_s$ of the stem 804, a length $l_r$ of the root 806, a diameter $d_r$ of the root 806, and a radius $r_r$ of the root 806. In a preferred embodiment, the radius $r_s$ of the stem 804 exceeds the radius $r_r$ of the root 806, although the relative dimensions of the antenna 800 may vary as suitable according to the particular application in which the antenna 800 is used. Preferably, the design dimensions of the antenna 800 are selected in accordance with the environment within which the antenna is intended to operate. For example, in a preferred embodiment, the design dimensions are selected according to an operating frequency, and a corresponding operating wavelength, or corresponding ranges of these, for the antenna 800.

Although selection of the design dimensions is a matter of design choice, as a designer must determine the relative importance of different performance criteria, some rules of thumb may accompany design intuition and numerical modeling of the design dimensions. For example, in a preferred embodiment, the desired length $l_s$ of the stem 804 of the modified top hat antenna 800 is approximately one-tenth to one-twelfth of the operating wavelength, or from $\lambda/10$.to $\lambda/12$, in the interest of minimizing the height of the antenna 800 above a PCB such as the PCB 808. Preferably, the height of the antenna 800 above the PCB 808 of FIG. 18 is roughly equivalent to the length $l_s$ of the stem 804. A design rule of thumb to achieve the length $l_s$ and to maintain acceptable performance that is comparable to the traditional top hat antenna 100 illustrated in FIG. 1, is to make the radius $r_h$ of the hat 802 approximately equivalent to the length $l_s$ of the stem 804 so that (2) and (3) above are satisfied. In a preferred embodiment, the radius $r_h$ of the hat 802 and the length $l_s$ of the stem 804 are selected to satisfy (3) and to minimize $l_s$. For example, if the length $l_s$ is selected to be approximately equal to $\lambda/12$, then according to (3) the radius $r_h$ should be approximately equal to $\lambda/12$. As another example, if the length $l_s$ is selected to be approximately equal to $\lambda/10$, then to satisfy (3) the radius $r_h$ should be approximately equal to $\lambda/13$.

Figure 22:
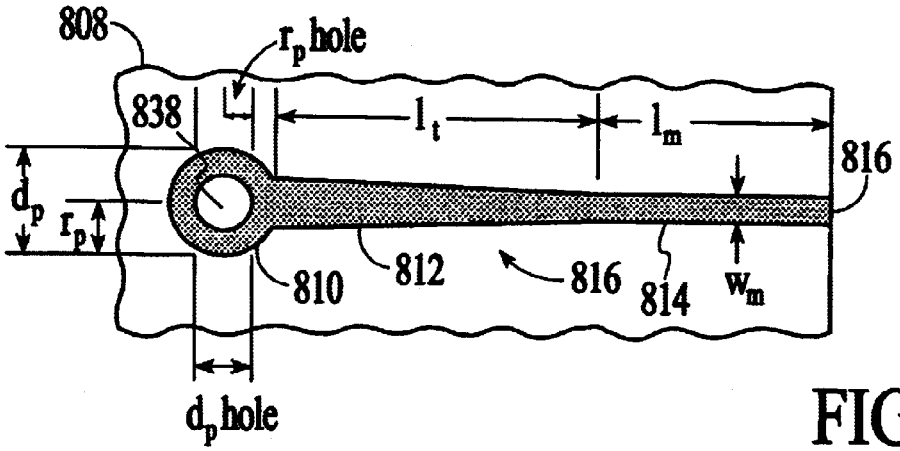
FIG. 22 is a diagram illustrating a top view of an exemplary transmission feed according to FIG. 18.

The antenna 800 of FIG. 19 is capable of being mounted on a PCB, as shown in FIG. 18. The antenna 800 of FIG. 19 is mounted on the PCB 808 and contacts a transmission feed 816 that is laid out along a top side of the PCB 808. FIG. 22 is a diagram illustrating a top view of the exemplary transmission feed 816 of FIG. 18 without the antenna 800. As noted above, the radius $r_s$ of the stem 804 is preferably longer than the radius $r_r$ of the root 806 for reasons that will become evident when viewing the antenna 800 of FIG. 18 and when reviewing the description below of mounting systems according to presently preferred embodiments. In FIG. 18, for example, the stem 804 is supported by the transmission feed 816, while the root 804 penetrates the PCB 808 through to a bottom side of the PCB 808. The transmission feed 816 of FIGS. 18 and 22 preferably includes a microstrip line 814, a taper region 812 and a contact area or connecting pad 810. Preferably, the transmission feed 816 is a microthin layer of metal film, such as copper, although other metals and conductive materials may be used as suitable. The connecting pad 810 of FIGS. 15 and 22 is preferably circular having a radius $r_p$ and diameter $d_p$ and is joined with the taper region 812. The root 804 and thus the antenna 800 are preferably secured to the PCB 808 by a process that solders or otherwise fuses the root 804 to the bottom of the PCB 808 as explained in more detail below.

The radius $r_r$ of the root 806 and preferably the radius $r_s$ of the stem 804 determine the radius $r_p$ and the diameter $d_p$ of the connecting pad 810 and the width of the taper region 812 where the taper region 812 joins with the connecting pad 810. The connecting pad 810 is preferably used to make electrical contact with the root 806 and thus the antenna 800, and to provide a surface to support the stem 804 and thus the antenna 800. Preferably, the root 806 penetrates the connecting pad 810 through a pad hole 838 of radius $r_{phole}$. Preferably, the pad hole 838 is shaped to firmly and tightly surround the root 806 to facilitate the electrical contact between the connecting pad 810 and the root 806. The diameter $d_{phole}$ of the pad hole 838 is preferably equivalent to the diameter $d_r$ of the root 806. The microstrip line 814, as is commonly known in the art, is a structure that behaves like a transmission line at microwave frequencies and that transmits electrical signals in conjunction with a dielectric layer and a ground plane, in this case with the PCB 808. For a given width, such as width $w_m$, of microstrip line and a given height of the microstrip line above a ground plane, typically the thickness of the PCB layer, there is an impedance associated with the microstrip line. Preferably, the taper region 812 is used to match the input impedance of the antenna 800 with the microstrip line 814. The length $l_t$ of the taper region 812 is dependent on how abrupt a transformation of the microstrip line 814 to the connecting pad 810 is acceptable for a particular application. The tradeoff for this parameter is between reducing the length $l_{feed}$ of the transmission feed 816 to save area on the PCB 808 and avoiding unwanted reflections that can result from a more abrupt transformation from the width $w_m$ of the microstrip line 814 to the width of the taper region 812 where the taper region 812 joins with the connecting pad 810.

Table III shows the results of a computer simulation run using a standard antenna design simulation software package, as well as the assumed values for various dimensions of an exemplary top hat antenna 800 implemented as in FIG. 18. The values for the dimensions of the exemplary top hat antenna 800 were obtained through iterative optimization using the software package. A exemplary prototype implementation of the top hat antenna 800 of FIG. 18 utilizes FR4® board as the dielectric material for the PCB 808. Some of the exemplary dimensions in Table III relate to a particular mounting system, shown in FIGS. 25 and 26 and described in more detail below, that was used in which the root 806 of the antenna 800 penetrated the PCB 808 and was soldered to the PCB 808 at the bottom side of the PCB 808.

TABLE III

Figure 25:
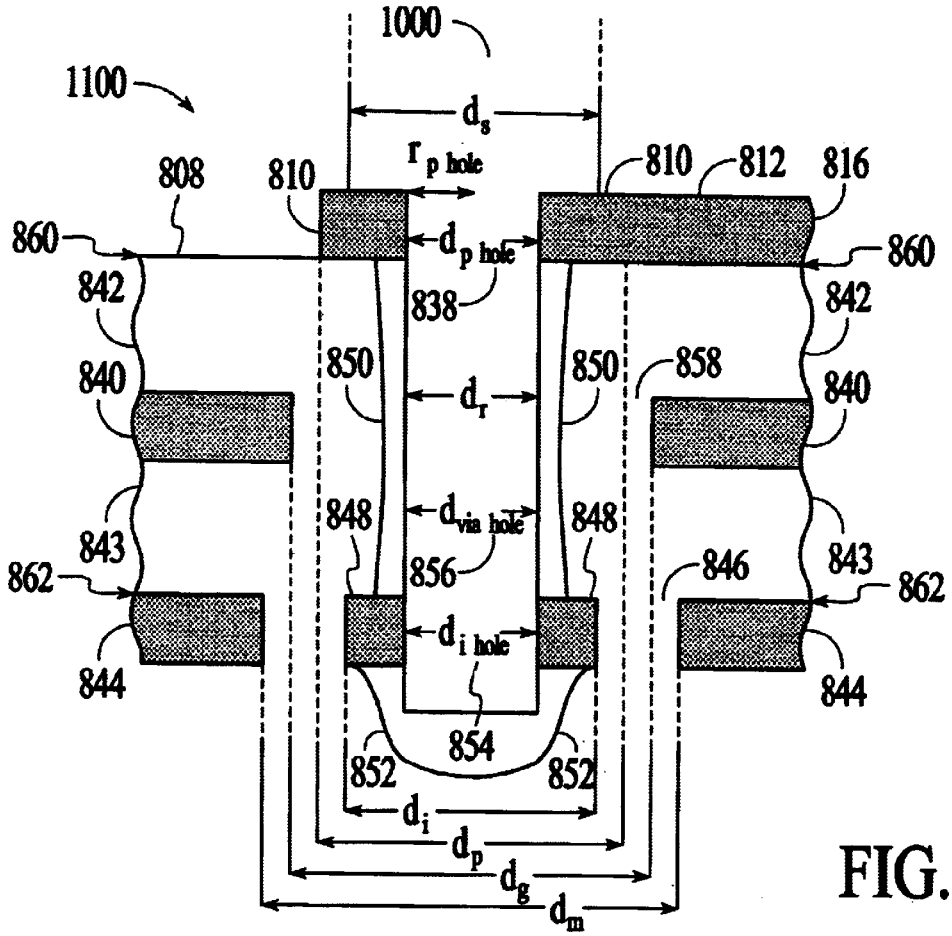
FIG. 25 is a diagram illustrating a side view of an exemplary mounting system, built into a printed circuit board according to a eighth presently preferred embodiment, to mount the exemplary antenna of FIG. 21.
Figure 26:
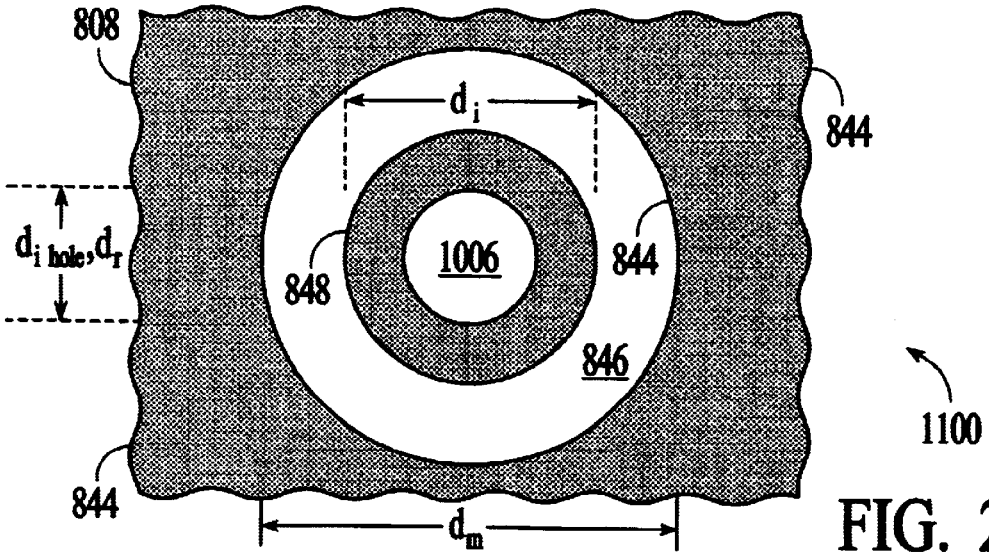
FIG. 26 is a diagram illustrating a bottom view of the exemplary mounting system of FIG. 25.

Simulation results for an exemplary implementation of the exemplary top hat antenna 800 with root 606 of FIG. 18; including dimensions of the exemplary transmission feed 816 of FIGS. 18, 23, and 25, and dimensions of the exemplary mounting system 1100 of FIGS. 25–26.

| Element/Dimension | Value |
|---|---|
| Operating Frequency | 5.25 GHz |
| Thickness of Hat 802 $t_h$ | 0.5 mm |
| Diameter of Hat 802 $d_h$; $2r_h$ | 11.5 mm |
| Length of Stem 804 $l_s$, ≈ Height above PCB 808 | 5 mm $\left[d_h = 2r_h \approx 2l_s;\ d_h + l_s = 2r_h + l_s \approx \frac{\lambda}{4}\right]$ |
| Diameter of Stem 804 $d_s$; $2r_s$ | 2 mm |
| Diameter of Root 806 $d_r$; $2r_r$; Diameter of Connecting Pad Hole 838 $d_{phole}$ | 1mm |
| Length of Root 806 $l_r$ | can vary; longer than PCB 808 thickness |
| Length of Transmission Feed 816 | 12.5 mm $[l_{feed} \cong d_p + l_t + l_m]$ |
| Thickness of Transmission Feed 816 | 0.07 mm (70 $\mu$m) |
| Impedance of Microstrip Line 814 | ~53 Ω |
| Width of Microstrip Line 814 $w_m$ | 0.4 mm |
| Length of Microstrip Line 814 $l_m$ | 4.5 mm |
| Length of Taper Region 812 $l_t$ | 6 mm |
| Width of Taper Region 812 at Connecting Pad 810 | 1 mm |
| Diameter of Connecting Pad 810 $d_p$; $2r_p$ | 2 mm |
| Diameter of Island 848 $d_i$ | 2 mm |
| Diameter of Island Hole 854 $d_{ihole}$ | 1 mm |
| Diameter of Via Hole 856 $d_{viahole}$ | 1 mm |
| Outer Diameter of Moat 846 (Ground Plane 844 Gap) $d_m$ | 2.4 mm |

TABLE III-continued

Simulation results for an exemplary implementation of the exemplary top hat antenna 800 with root 606 of FIG. 18; including dimensions of the exemplary transmission feed 816 of FIGS. 18, 23, and 25, and dimensions of the exemplary mounting system 1100 of FIGS. 25–26.

| Element/Dimension | Value |
|---|---|
| Diameter of Relief 858 in Middle Ground Plane 840 $d_g$ | 2 mm |
| FR4 ® board (PCB 808) | $\epsilon_R \approx 4.25$ |

Note: In a preferred embodiment, a foam, for example polystyrene, cylinder of height 4.5 mm, diameter ~ 12 mm, and having a 2 mm hole along the cylinder axis, could be used for vibration dampening and stem 804 protection.

Figure 34:
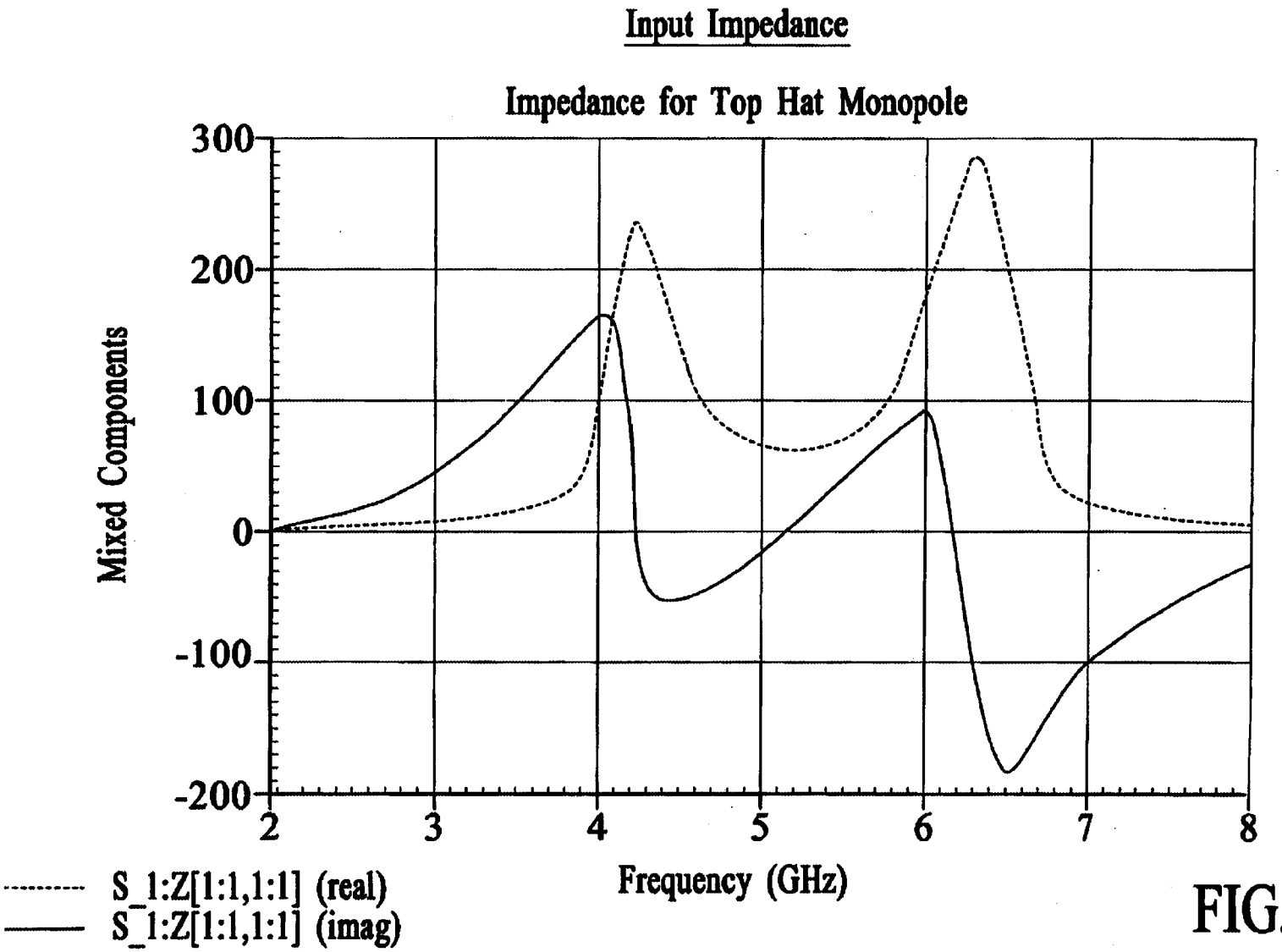
FIG. 34 is a graph illustrating performance characteristics relating to input impedance for an exemplary implementation of the exemplary antenna of FIG. 18.
Figure 35:
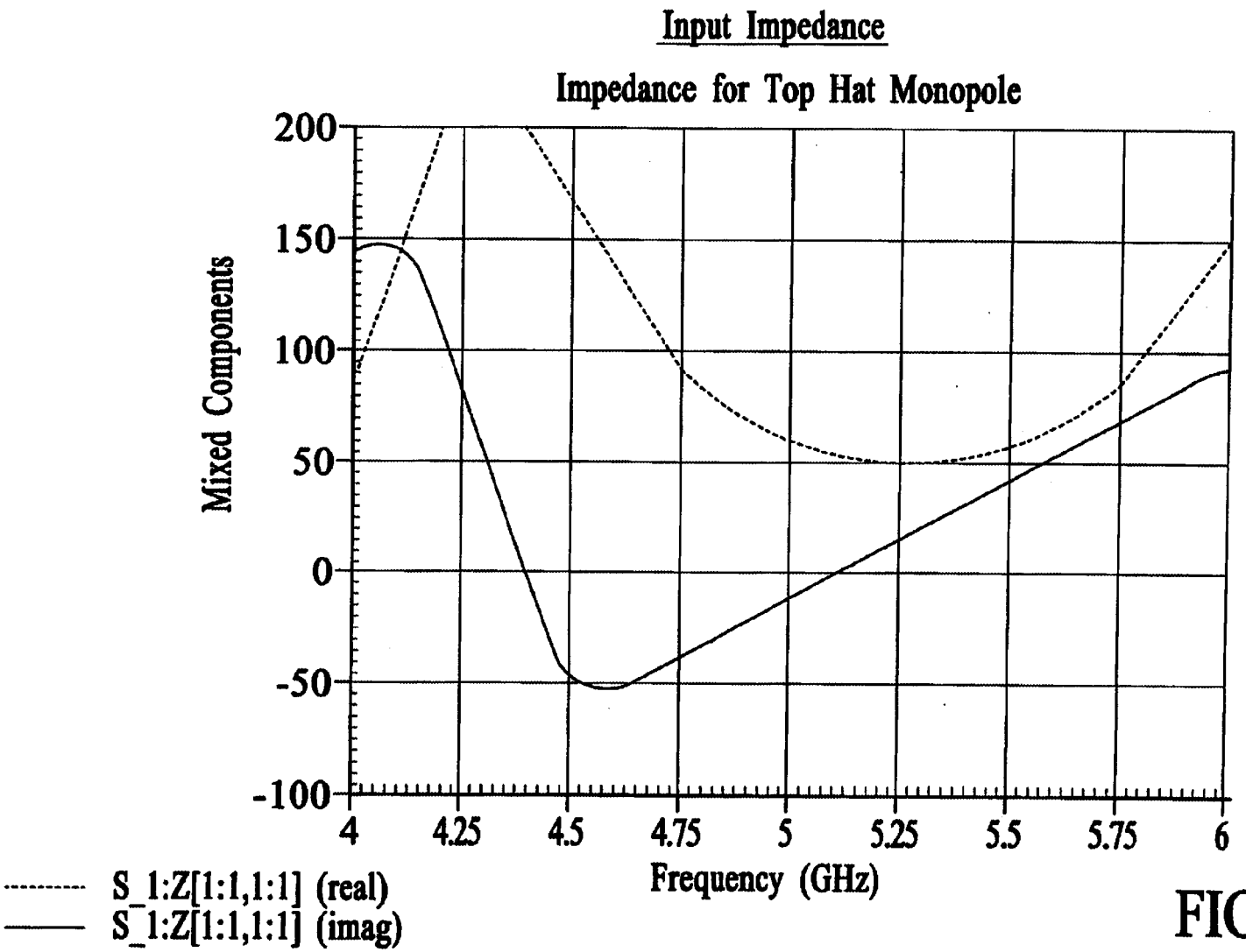
FIG. 35 is a magnified view of the graph of FIG. 34.
Figure 36:
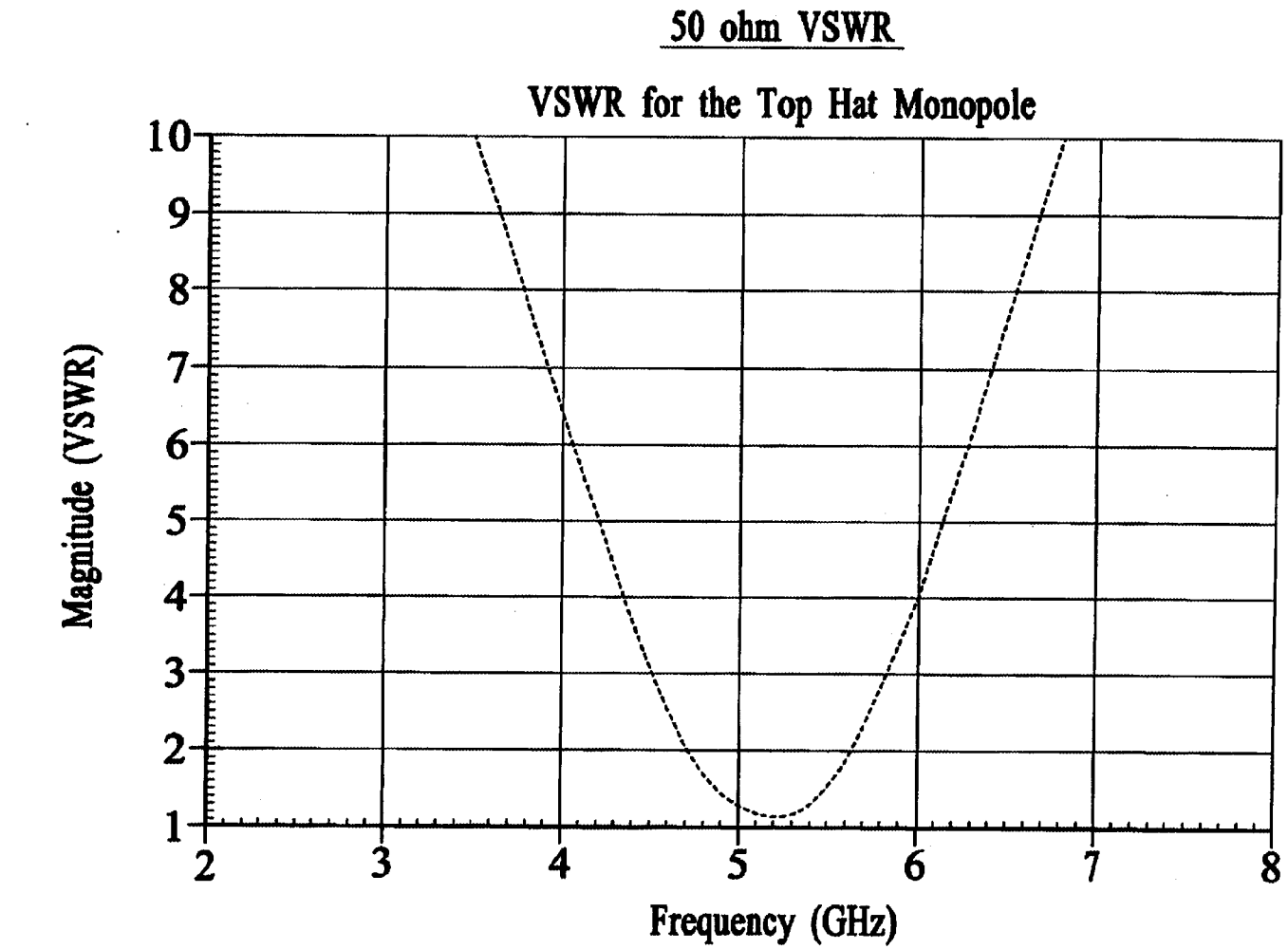
FIG. 36 is a graph illustrating performance characteristics relating to bandwidth for the exemplary implementation of the exemplary antenna of FIG. 18.
Figure 37:
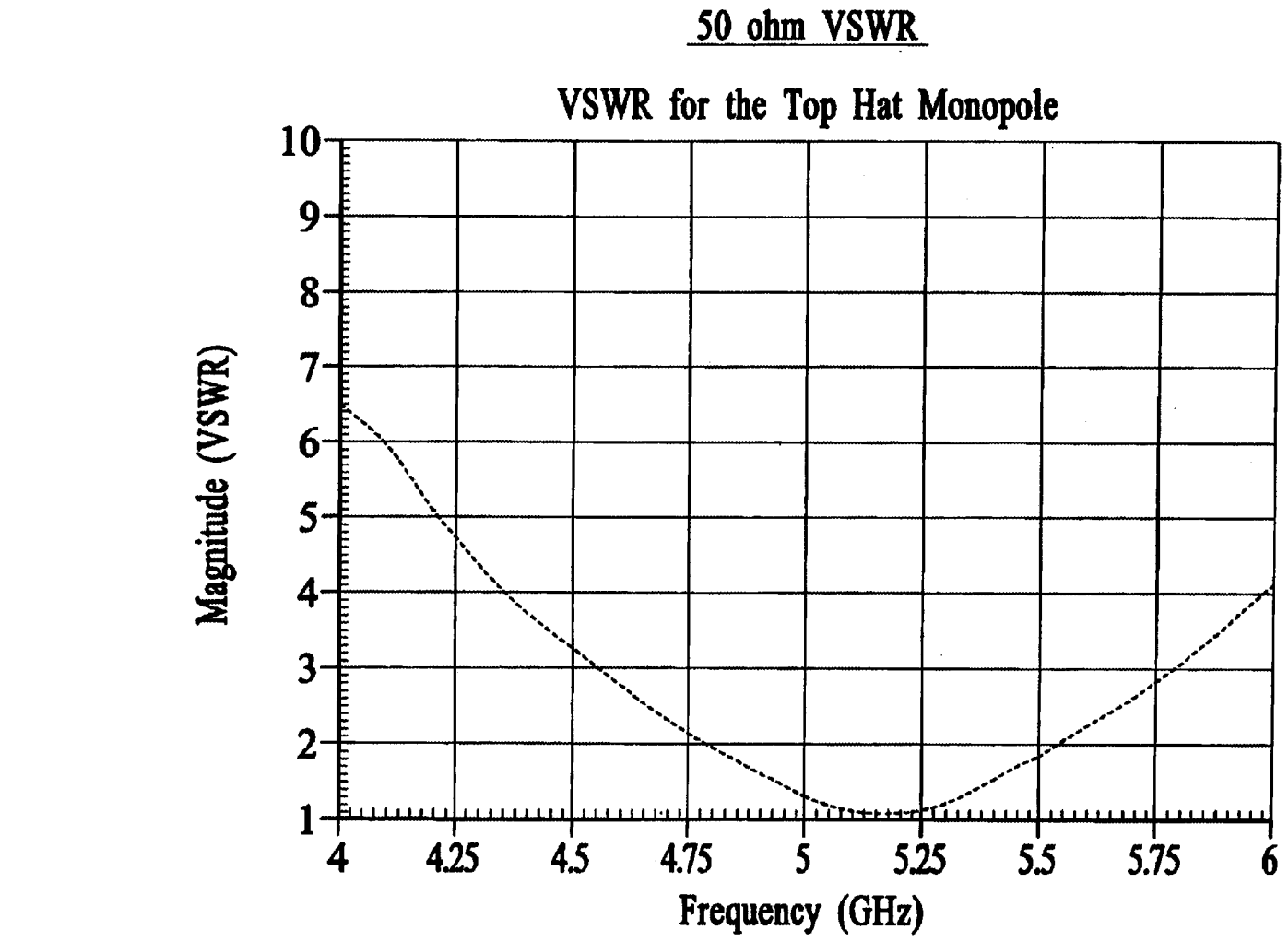
FIG. 37 is a magnified view of the graph of FIG. 36.

FIGS. 34–37 are graphs illustrating performance characteristics relating to input impedance and the bandwidth according to the exemplary implementation of the exemplary top hat antenna 800 of FIG. 15. In FIG. 34, the real and imaginary parts of the input impedance, in units of Ohms (Ω), of the antenna 800 on the vertical scale are plotted against frequency, in unit of GHz, on the horizontal scale. FIG. 35 is a magnified portion of the graph in FIG. 34, focused so that the real part of the input impedance for the operating frequency can more easily be discerned. At the operating frequency $f$ of 5.25 GHz, the real part of the input impedance is around 50 Ω, so that the microstrip line 814 of the transmission feed 816, which has an impedance of 50 Ω as shown in Table II, is effectively matched by the antenna 800. In FIG. 36 the bandwidth of the antenna is shown with the magnitude of the voltage standing wave ratio (VSWR) plotted on the vertical scale against frequency on the horizontal scale. The bandwidth for a VSWR less than 3 is around 1150 MHz, between 4.6 GHz and 5.75 GHz. FIG. 37 is a magnified portion of the graph in FIG. 36, focused so that the bandwidth for a VSWR less than 2 can more easily be discerned. The bandwidth for VSWR<2 is around 750 MHz, between 4.8 GHz and 5.55 GHz. In a neighborhood of the operating frequency $f$=5.25 GHz, the bandwidths are comparable to the bandwidths associated with a traditional top hat antenna, such as the top hat antenna 100 of FIG. 1.

Antenna Mounting Systems

Figure 21:
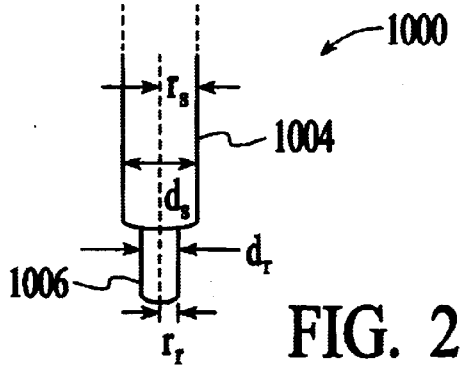
FIG. 21 is a diagram illustrating an exemplary portion of an exemplary antenna capable of being mounted on a printed circuit board in an exemplary mounting system shown in FIGS. 25–26.

FIG. 25 is a diagram illustrating a side view of an exemplary mounting system 1100, built into the PCB 808 according to an eighth presently preferred embodiment, to mount an exemplary antenna 1000. FIG. 21 is a diagram illustrating an exemplary portion of the exemplary antenna 1000 capable of being mounted on, for example, the PCB 808 in the exemplary mounting system 1100. The antenna 1000 portion includes a cylindrical stem 1004 of radius $r_s$ and diameter $d_s$, and a cylindrical root 1006 of radius $r_r$ and diameter $d_r$. The antenna 1000 is intended to represent any of a wide variety of antennas having this configuration and is consistent with, for example, the exemplary modified top hat antenna 800 of FIGS. 18 and 19. The antenna 1000 can also be, for example, a modified straight wire monopole antenna, or a modified inverted L monopole antenna. The antenna 1000 is configured for insertion into an opening, such as a via hole, in the PCB 808.

The exemplary mounting system 1100 built into the PCB 808 preferably includes the transmission feed 816 of FIGS. 18 and 22, an upper layer 842 of dielectric material, a lower layer 843 of dielectric material, a ground plane 844, and an intermediate ground plane 840 located in between the dielectric material layers 842, 843 so that the ground plane 840 is located on a top side of the lower dielectric layer 843. Although two layers of dielectric material are illustrated, the presently preferred embodiments and methods and systems described herein are not limited to two layers, and any number of layers may be used as suitable. The upper dielectric layer 842 has a top side 860 and is located on a top side of the intermediate ground plane 840. The lower dielectric layer 843 has a bottom side 862. The ground plane 844 is located and laid out along the bottom side 862 of the lower dielectric layer 843 and the PCB 808. The dielectric material for the layers 842, 843 can be, for example, a dielectric substrate such as FR4® board material, although other dielectric materials may be used as suitable. Preferably, the transmission feed 816 is located and laid out along the top side 860 of the upper dielectric layer 842 and the PCB 808. Preferably, the transmission feed 816 provides the antenna 1000 with electrical signals. Preferably, the transmission feed 816 and the ground planes 840, 844 are microthin layers of metal film, such as copper, although other metals and conductive materials may be used as suitable. An exemplary thickness for the feed 816 and the ground planes 840, 844 is 70 microns (0.07 mm) although any standard thicknesses or other thickness may be used as suitable. As described above, the transmission feed 816 preferably includes a microstrip line 814, a taper region 812, and a contact area or connecting pad 810 to receive and support the antenna 1000. The connecting pad 810 has a diameter $d_p$ and a radius $r_p$ while the connecting pad hole 838 has a diameter $d_{phole}$ and a radius $r_{phole}$. Although the system 1100 includes an intermediate ground plane 840, in other embodiments, no intermediate ground plane 840 is utilized. Generally, one or more ground planes, or positive DC supply planes, may be used as suitable.

Preferably an opening, for example a via hole 856, is formed through the PCB 808 and the dielectric layers 842, 843. Preferably, the opening is formed by boring or drilling through the PCB 808, with, for example, a drilling tool. Of course, any suitable tool may be used. The opening in the PCB 808 can be formed as a via hole 856 having a diameter $d_{viahole}$. As is known in the art, a via hole is a hole that is bored into a substrate, typically in order to make a shunt connection between two or more conductors. The via hole 856 is preferably a plated through-hole with plating 850 forming the walls of the via hole 856. The PCB 808 and the dielectric layers 842, 843 are preferably configured to receive the antenna 1000 through the opening. As illustrated in FIG. 25, the antenna 1000 is inserted into the opening on the top side 860 of the upper dielectric layer 842 and the PCB 808, through the connecting pad hole 838. Preferably, the cylindrical root 1006 is inserted through the connecting pad 810 into the opening on the top side 860 of the PCB 808. Preferably, the cylindrical root 1006 makes electrical contact with the transmission feed 816. Preferably, the connecting pad hole 810 of the transmission feed 816 fully surrounds the cylindrical root 1006 to make electrical contact. Preferably, the connecting pad 810 supports the cylindrical stem 1004. The step drop in radius from the cylindrical stem 1004 to the cylindrical root 1006 provides mechanical stability for the antenna 1000. That is, the antenna 1000, when secured to the bottom of the PCB 808, will not be permitted to wobble due to the shapes of the connecting pad 810 and the stem 1004 and root 1006 of the antenna 1000. The stem 1004 preferably rests on the connecting pad 810 while the root 1006 preferably fits snugly into the connecting pad hole 838, preventing lateral movement of the antenna 1000.

The system 1100 includes an island 848 having a diameter $d_i$ and a radius $r_i$. The island 848 includes an island hole 854 having a diameter $d_{ihole}$ and radius $r_{ihole}$. Preferably, the island 848 is surrounded and defined by a circular gap area or moat 846 having an outer diameter $d_m$. The moat 846 preferably serves the purpose of providing electrical separation between the island 848 and the ground plane 844, so that the island 848 does not make contact with the ground plane 844. In a preferred embodiment, the moat 846 is created in the ground plane 844 to form the island 848. Preferably, the opening is formed through the island 848 along with the PCB 808 including the intermediate ground plane 840, and the dielectric layers 842, 843 so that the island 848 is configured to receive the antenna 1000 through the opening and the island hole 854. Preferably, the moat 846 is formed by etching in a PCB process fabrication step. Process fabrication steps, including etching processes, are well known in the art. Preferably, the middle or intermediate ground plane 840 includes a hole, or relief 858 having a diameter $d_g$. Preferably, the opening, the via hole 854, the relief 858, the island hole 854, and the moat 846 are formed together and thus configure the respective elements with which they are associated to receive the antenna 1000.

Preferably, the root 1006 of the antenna 1006 protrudes through the opening in the island 848 on the bottom side 862 of the PCB 808 once the antenna 1000 is inserted into the via hole 856. The root 1006 of the antenna 1000 is preferably secured to the PCB 808 at the bottom side of the PCB 808 using a soldering process along the bottom side 862 of the PCB 808. Of course, any suitable fusing process may be used to fix the antenna 1000 to the PCB 808.

The island 848 is preferably configured to receive a material 854 to secure the antenna 1000 to the island. The material 854, for example, soldering metal, is preferably introduced along the bottom side of the PCB 808 over the island 848 and into the via hole 856 if applicable to secure the antenna 1000 to the PCB 808. Any suitable material 854 may be used; for example, soldering material may be used. In a preferred embodiment, the material 854 is introduced into the via hole 856 to fill any open areas between the antenna 1000 and the opening or via hole 856 via capillary attraction. As is known in the art, capillary attraction pulls the solder up into the opening to fill in any gap between the root 1006 and the plated-through hole, or via hole 856.

FIG. 26 is a diagram illustrating a bottom view of the exemplary mounting system 1100 of FIG. 25. Preferably, the root 1006 of the antenna 1000 protrudes from the island hole 854 in the island 848, while the moat 846 separates the island 848 from the ground plane 844. The material 852, such as metal solder, that is used to affix the cylindrical root 1006 of the antenna 1000 to the island 848 and thus to the PCB 808, is not shown in FIG. 26 for clarity.

Figure 20:
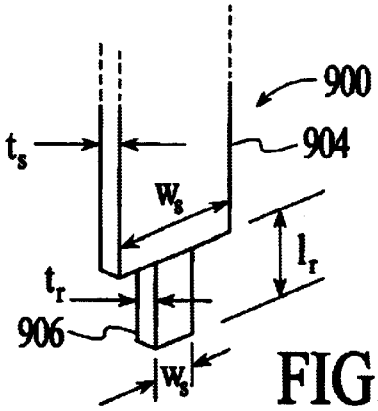
FIG. 20 is a diagram illustrating an exemplary portion of an exemplary antenna capable of being mounted on a printed circuit board in a exemplary mounting system shown in FIG. 27.

FIG. 27 is a diagram illustrating a side view of an exemplary mounting system 1200, built into the PCB 608 according to an ninth presently preferred embodiment, to mount an exemplary antenna 900. FIG. 20 is a diagram illustrating an exemplary portion of the exemplary antenna 900 capable of being mounted on, for example, the PCB 608 in a exemplary mounting system 1200. The antenna 900 portion includes a planar stem 904 of width $w_s$ and thickness $t_s$, and a planar root 906 of width $w_r$, length $l_r$, and thickness $t_r$. The antenna 900 is intended to represent any of a wide variety of antennas having this configuration and is consistent with, for example, the exemplary antenna 300 of FIGS. 5–7 and the exemplary antenna 600 of FIGS. 13–15. The antenna 900 can also be, for example, a modified straight wire monopole antenna, or an modified inverted L monopole antenna. The antenna 900 is configured for insertion into an opening, such as a via hole, in the PCB 608.

The exemplary mounting system 1200 built into the PCB 608 preferably includes the transmission feed 616 of FIGS. 15 and 23, a layer 642 of dielectric material, and a ground plane 644. The dielectric layer 642 has a top side 660 and a bottom side 662. The ground plane 644 is located and laid out along the bottom side 662 of the dielectric layer 642 and the PCB 608. The dielectric material can be, for example, a dielectric substrate such as FR4® board material, although other dielectric materials may be used as suitable. Preferably, the transmission feed 616 is located and laid out along the top side 660 of the dielectric layer 642 and the PCB 608. Preferably, the transmission feed 616 provides the antenna 900 with electrical signals. Preferably, the transmission feed 616 and the ground plane 644 are microthin layers of metal film, such as copper, although other metals and conductive materials may be used as suitable. An exemplary thickness for the feed 616 and the ground plane 644 is 70 microns (0.07 mm) although any standard thicknesses or other thickness may be used as suitable. As described above, the transmission feed 616 preferably includes a microstrip line 814, a taper region 812, and a contact area or connecting pad 610 to receive and support the antenna 900. The connecting pad 610 has a diameter $d_p$ and a radius $r_p$ while the connecting pad hole 638 has a diameter $d_{phole}$ and a radius $r_{phole}$. Although the system 1200 includes one ground plane 644, in other embodiments such as in the system 1100 of FIGS. 25–26, more than one ground plane is utilized. Generally, one or more of ground planes may be used as suitable.

Preferably an opening, for example a via hole 656, is formed through the PCB 608 and the dielectric layer 642. Preferably, the opening is formed by boring or drilling through the PCB 608, with, for example, a drilling tool. Of course, any suitable tool may be used. The opening in the PCB 608 can be formed as a via hole 656 having a diameter $d_{viahole}$. As is known in the art, a via hole is a hole that is bored into a substrate, typically in order to make a shunt connection between two or more conductors. The via hole 656 is preferably a plated through-hole with plating 650 forming the walls of the via hole 656. The PCB 608 and the dielectric layer 642 are preferably configured to receive the antenna 900 through the opening. As illustrated in FIG. 25, the antenna 900 is inserted into the opening on the top side 660 of the dielectric layer 642 and the PCB 608, through the connecting pad hole 638. Preferably, the planar root 906 is inserted through the connecting pad 610 into the opening on the top side 660 of the PCB 608. Preferably, the planar root 906 makes electrical contact with the transmission feed 616. Preferably, the connecting pad hole 610 of the transmission feed 616 fully surrounds the planar root 906 to make electrical contact. Preferably, the connecting pad 610 supports the planar stem 904. The step drop in width from the planar stem 904 to the planar root 906 provides mechanical stability for the antenna 900. That is, the antenna 900, when secured to the bottom of the PCB 608, will not be permitted to wobble due to the shapes of the connecting pad 610 and the stem 904 and root 906 of the antenna 900. The stem 904 preferably rests on the connecting pad 610 while the root 906 preferably fits snugly into the connecting pad hole 638, preventing lateral movement of the antenna 900.

The system 1200 includes an island 648 having a diameter $d_i$ and a radius $r_i$. The island 648 includes an island hole 654 having a diameter $d_{ihole}$ and radius $r_{ihole}$. Preferably, the island 648 is surrounded and defined by a circular gap area or moat 646 having an outer diameter $d_m$. The moat 646 preferably serves the purpose of providing electrical separation between the island 648 and the ground plane 644, so that the island 648 does not make contact with the ground plane 644. In a preferred embodiment, the moat 646 is created in the ground plane 644 to form the island 648. Preferably, the opening is formed through the island 648 along with the PCB 608 and the dielectric layer 642 so that the island 648 is configured to receive the antenna 900 through the opening and the island hole 654. Preferably, the moat 646 is formed by etching in a PCB process fabrication step. Process fabrication steps, including etching processes, are well known in the art. Preferably, the opening or via hole 656, the island hole 654, and the moat 646 are formed together and thus configure the respective elements with which they are associated to receive the antenna 900.

Preferably, the root 906 of the antenna 906 protrudes through the opening in the island 648 on the bottom side 662 of the PCB 608 once the antenna 900 is inserted into the via hole 656. The root 906 of the antenna 900 is preferably secured to the PCB 608 at the bottom side of the PCB 608 using a soldering process along the bottom side 662 of the PCB 608. Of course, any suitable fusing process may be used to fix the antenna 900 to the PCB 608.

The island 648 is preferably configured to receive a material 652 to secure the antenna 900 to the island. The material 652, for example, soldering metal, is preferably introduced along the bottom side of the PCB 608 over the island 648 and into the via hole 656 if applicable to secure the antenna 900 to the PCB 608. Any suitable material 652 may be used; for example, soldering material may be used. In a preferred embodiment, the material 652 is introduced into the via hole 656 to fill any open areas between the antenna 900 and the opening or via hole 656 via capillary attraction. As is known in the art, capillary attraction pulls the solder up into the opening to fill in any gap between the root 906 and the plated-through hole, or via hole 656.

Preferably, the design dimensions of the antennas 1000, 900 and the mounting systems 1100, 1200 are selected in accordance with the operating frequency and the environment within which the antenna is intended to operate. For example, in a preferred embodiment, the design dimensions are selected according to an operating frequency, and a corresponding operating wavelength, or corresponding ranges of these, for the antennas 1000, 900.

Although selection of the design dimensions is a matter of design choice, as a designer must determine the relative importance of different performance criteria, some rules of thumb may accompany design intuition and numerical modeling of the design dimensions. For antennas that include a circular hat and a stem, the design rule of thumb to achieve the length $l_s$ of around $\lambda/12$ to $\lambda/10$ and to maintain acceptable performance that is comparable to the traditional top hat antenna 100 illustrated in FIG. 1, is to make the radius $r_h$ of the antenna hat approximately equivalent to the length $l_s$ of the stem as in (2) and (3). This rule may apply to the antennas 1000, 900, depending on the type of antenna that is used.

Definitions as well as rules of thumb to achieve desired performance may be formulated as well for the design dimensions of the mounting system 1100 (1200) of FIGS. 25–26 (FIG. 27).

By definition, and referring to FIGS. 25–26 (FIG. 27):

$$d_m > d_i > d_{ihole}, \tag{4}$$

that is, the outer diameter $d_m$ of the moat 846 (646) exceeds the diameter $d_i$ of the island 848 (648), while the island 848 (648) exceeds the diameter $d_{ihole}$ of the island hole 854 (654).

Preferably, the diameters of the holes related to the opening that receive the antenna 1000 (900) are approximately equivalent:

$$d_{ihole} \cong d_{viahole}, \tag{5}$$

that is, the diameter $d_{ihole}$ of the island hole 854 (654), and the diameter of the via hole 856 (656) are preferably equivalent to each other. Of course, these dimensions may vary in practice according to processes but are preferably designed to be equivalent.

Generally, the diameter $d_{phole}$ (width $w_{phole}$) of the connecting pad hole 838 (638) is greater than or equal to the diameter $d_r$ (width $w_r$) of the cylindrical (planar) root 1006 (906):

$$d_{phole} \geqq d_r (w_{phole} \geqq w_r). \tag{6}$$

Since the connecting pad hole 838 (638) preferably fully surrounds the cylindrical (planar) root 1006 (906) in order to achieve electrical contact between the transmission feed 816 (616) and the cylindrical (planar) root 1006 (906), then preferably the diameter $d_{phole}$ (width $w_{phole}$) of the connecting pad hole 838 (638) is approximately equivalent to the diameter $d_r$ (width $w_r$) of the cylindrical (planar) root 1006 (906):

$$d_{phole} \cong d_r (w_{phole} \cong w_r). \tag{7}$$

Preferably, the diameter $d_s$ (width $w_s$) of the cylindrical (planar) stem 1004 (904) exceeds the diameter $d_r$ (width $w_r$) of the cylindrical (planar) root 1006 (906):

$$d_s \geqq d_r (w_s \geqq w_r), \tag{8}$$

and by definition and by (6):

$$d_p > d_{phole} \geqq d_r (d_p > w_{phole} \geqq w_r), \tag{9}$$

that is, the diameter $d_{phole}$ (width $w_{phole}$) of the connecting pad hole 838 (638) is less than the diameter $d_p$ of the connecting pad 810 (610) and is greater than or equal to the diameter $d_r$ ($w_r$)of the cylindrical (planar) root 1006 (906). Preferably, for support of the stem 1004 (904), the diameter $d_p$ of the connecting pad 810 (610) exceeds the diameter $d_s$ ($w_s$) of the stem 1004 (904):

$$d_p > d_s (d_p > w_s), \tag{10}$$

so that preferably, and by (7):

$$d_p > d_s > d_{phole} \cong d_r (d_p > w_s > w_{phole} \cong w_r), \tag{11}$$

with solder or another material preferably filling in any open areas between the cylindrical (planar) root 1006 (906) and the via hole 856 (656).

The following relationships between design dimensions are preferable for optimum performance of the antenna 1000 (900) in the mounting system 1100 (1200) with regard to bandwidth, and input and output impedance, although of course any suitable dimensions may be used.

Preferably, the diameter $d_i$ of the island 848 (648) is greater than the diameter $d_r$ ($w_r$) of the cylindrical (planar) root 1006 (906):

$$d_i > d_r (d_i > w_r). \quad (12)$$

As the diameter $d_i$ of the island 848 (648) increases relative to the diameter $d_r$ ($w_r$)of the cylindrical (planar) root 1006 (906) the output impedance of the antenna decreases.

Preferably, the diameter $d_g$ of the relief 858 in the intermediate ground plane 840 and the outer diameter $d_m$ of the gap area or moat 846 (646) are, respectively, greater than or equal to the diameter $d_p$ of the connecting pad 838 (638) as follows:

$$d_g \geqq d_p, \quad (13)$$

and $$d_m \geqq d_p (d_m \geqq d_p). \quad (14)$$

As used herein, the term transmission feed is intended to refer to a feed structure that may include a transmission line structure as well as a contact area or connecting pad. The transmission line structure may include a distributed element such as a microstrip line, or for example, a stripline. As is known in the art, a stripline is a strip of metal, for example, copper, sandwiched between two ground planes and a dielectric material. The transmission line structure may be any suitable implementation that may be modeled as a transmission line.

As used herein, the term bendable is intended broadly to refer to any configuration or state of affairs that allows bending to occur. For example, a material may be thin enough or pliant enough to bend. Any such material is thus bendable. As another example, a material may contain an impression or a ridge along a desired bending line that aids in bending the material. Any such material is thus bendable.

The antennas and mounting system described herein according to the presently preferred embodiments satisfy performance requirements with regard to impedance and bandwidth and minimize the corresponding area required on a PCB while reducing the costs associated with the manufacturing, mounting, and soldering processes. The antennas and mounting systems may be designed to operate according to a wide variety of frequencies and in a wide range of environments.

Although the present invention has been particularly described with reference to the preferred embodiments, it should be readily apparent to those of ordinary skill in the art that changes and modifications in the form and details may be made without departing from the spirit and scope of the invention. It is intended that the appended claims include such changes and modifications.

What is claimed is:

1. A method of manufacturing an antenna capable of being mounted on a printed circuit board, comprising:

selecting the design dimensions of a unitary piece of material according to an operating wavelength;

stamping out the unitary piece of material from a larger section of material according to the design dimensions to form a stem monopole antenna, the unitary piece comprising:

a circular area having a center and an outer region; and a stem area having a first end and a second end, the first end joined with the center, the unitary piece bendable at the first end and the center.

2. The method of claim 1 wherein the stem area has a first side and a second side.

3. The method of claim 2 wherein stamping out the unitary piece of material further comprises:

cutting the stem area out of the circular area along the first side and along the second side while leaving the first end joined with the center.

4. The method of claim 1 further comprising:

determining the operating wavelength from an operating frequency.

5. The method of claim 1 further comprising:

bending the unitary piece at the first end and the center so that the circular area is perpendicular to the stem area.

6. The method of claim 1 wherein the design dimensions comprise:

a radius defined from the center to a point on the outer region along a radial axis.

7. The method of claim 6 wherein the radius is approximately equal to one twelfth of the operating wavelength.

8. The method of claim 6 wherein the radius is approximately equal to one thirteenth of the operating wavelength.

9. The method of claim 6 wherein the stem area protrudes outward from the center along the radial axis.

10. The method of claim 1 wherein the design dimensions comprise:

a radius defined from the center to a point on the outer region along a radial axis; and a stem length defined from the first end to the second end.

11. The method of claim 10 wherein the stem length is approximately equal to the radius.

12. The method of claim 10 wherein the stem length is approximately equal to one twelfth of the operating wavelength.

13. The method of claim 10 wherein the stem length is approximately equal to one tenth of the operating wavelength.

14. The method of claim 1 wherein the larger section of material is planar.

15. The method of claim 1 wherein the unitary piece of material is planar prior to bending of the unitary piece.

16. The method of claim 1 further comprising:

bending the unitary piece into a shape capable of operating as an antenna.

17. The method of claim 1 wherein the unitary piece of material comprises a piece of flat metal such that the circular area and the stem area together comprise a continuous disk of metal between the center and the outer region.

18. The method of claim 1, wherein the second end of the stem area is adapted to connect to a microstrip line when the antenna is mounted on the printed circuit board.

19. A method of manufacturing an antenna capable of being mounted on a printed circuit board comprising:

selecting design dimensions of a unitary piece of material according to an operating wavelength;

stamping out the unitary piece of material from a larger section of material according to the design dimensions to form an antenna the unitary piece comprising:

a circular area having a center and an outer region; and a stem area having a first end and a second end, the first end joined with the center, the unitary piece bendable at the first end and the center, wherein the stem area is not tapered between the first end and the second end so that a first width at the first end of the stem area is equivalent to a second width at the second end of the stem area.

20. A method of manufacturing an antenna capable of being mounted on a printed circuit board, comprising:

selecting design dimensions of a unitary piece of material according to an operating wavelength;

stamping out the unitary piece of material from a larger section of material according to the design dimensions to form an antenna, the unitary piece comprising:

a circular area having a center and an outer region; and a stem area having a first end and a second end, the first end joined with the center, the unitary piece bendable at the first end and the center, wherein the stem area exhibits a step change in width between the first end and the second end so that a first width at the first end of the stem area exceeds a second width at the second end of the stem area.

21. A method of manufacturing an antenna capable of being mounted on a printed circuit board comprising:

selecting design dimensions of a unitary piece of material according to an operating wavelength;

stamping out the unitary piece of material from a larger section of material according to the design dimensions to form an antenna, the unitary piece comprising:

a circular area having a center and an outer region; and a stem area having a first end and a second end, the first end joined with the center, the unitary piece bendable at the first end and the center, wherein the stem area is gradually tapered between the first end and the second end so that a first width at the first end of the stem area exceeds a second width at the second end of the stem area.

22. A method of manufacturing an antenna capable of being mounted on a printed circuit board, comprising:

selecting the design dimensions of a unitary piece of material according to an operating wavelength;

stamping out the unitary piece of material from a larger section of material according to the design dimensions to form an antenna, the unitary piece comprising:

a circular area having a center and an outer region; and a stem area having a first end and a second end, the first end joined with the center, the unitary piece bendable at the first end and the center;

a foot area having a third end and a fourth end, the third end joined with the second end, the unitary piece bendable at the third end and the second end.

23. The method of claim 22 wherein the stem area has a first side and a second side.

24. The method of claim 23 wherein stamping out the unitary piece of material further comprises:

cutting the stem area out of the circular area along the first side and along the second side while leaving the first end joined with the center.

25. The method of claim 22 further comprising:

bending the unitary piece so that the circular area is perpendicular to the stem area, and so that the stem area is perpendicular to the foot area.

26. The method of claim 22, further comprising:

bending the unitary piece at the first end and the center so that the circular area is perpendicular to the stem area.

27. The method of claim 22 further comprising:

bending the unitary piece at the third end and the second end so that the stem area is perpendicular to the foot area.

28. The method of claim 22 wherein the design dimensions comprise:

a radius defined from the center to a point on the outer region along a radial axis;

a stem length defined from the first end to the second end; and a foot length defined from the third end to the fourth end.

29. The method of claim 22 wherein a first width at the second end of the stem area is equivalent to a second width at the third end of the stem area.

30. The method of claim 29 wherein the stem area is not tapered between the first end and the second end so that a third width at the first end of the stem area is equivalent to the first width at the second end of the stem area.

31. The method of claim 29 wherein the stem area is gradually tapered between the first end and the second end so that a third width at the first end of the stem area exceeds the first width at the second end of the stem area.

* * * * *